United States Patent [19]

Hornkohl

[11] 4,066,028

[45] Jan. 3, 1978

[54] GUIDING, STITCHING AND DELIVERING SYSTEM

[75] Inventor: Owen T. Hornkohl, Webster Groves, Mo.

[73] Assignee: Angelica Corporation, St. Louis, Mo.

[21] Appl. No.: 684,660

[22] Filed: May 10, 1976

Related U.S. Application Data

[62] Division of Ser. No. 458,570, April 8, 1974, Pat. No. 3,986,467.

[51] Int. Cl.[2] ..... D05B 33/00

[52] U.S. Cl. ..... 112/121.29; 214/6 DK; 112/121.11

[58] Field of Search ..... 112/121.29, 121.11, 112/203, 130, 252; 214/6 DK; 250/561

[56] References Cited

U.S. PATENT DOCUMENTS

| | | | |
|---|---|---|---|
| 3,054,516 | 9/1962 | Joa | 214/6 DK |
| 3,182,619 | 5/1965 | Sally | 112/203 |
| 3,414,138 | 12/1968 | Junemann et al. | 214/6 DK |
| 3,611,961 | 10/1971 | Lopez et al. | 112/121.29 X |
| 3,614,453 | 10/1971 | Johnson | 250/561 |
| 3,618,546 | 11/1971 | Preston | 112/121.29 |
| 3,750,603 | 8/1973 | Martin | 112/121.11 X |

FOREIGN PATENT DOCUMENTS

| | | | |
|---|---|---|---|
| 6,615,675 | 5/1968 | Netherlands | 214/6 DK |

*Primary Examiner*—Werner H. Schroeder
*Assistant Examiner*—Peter Nerbun
*Attorney, Agent, or Firm*—Rogers, Eilers & Howell

[57] ABSTRACT

A guiding, stitching and delivering system continuously constrains a piece of material while it guides that piece of material beneath the needle of a sewing machine during the stitching of that piece of material, while that piece of material is stationary during the period of time between the completion of the stitching of that piece of material and the start of the stitching of the next-succeeding piece of material, while the stitches between the trailing edge of that piece of material and the leading edge of that next-succeeding piece of material are being cut, and while that piece of material is being moved to a delivery area. That guiding, stitching and delivering system obviates the formation of needless stitches, places all stitches in the desired locations, and provides certain and easy cutting of the stitches between the trailing edge of that piece of material and the leading edge of that next-succeeding piece of material.

7 Claims, 16 Drawing Figures

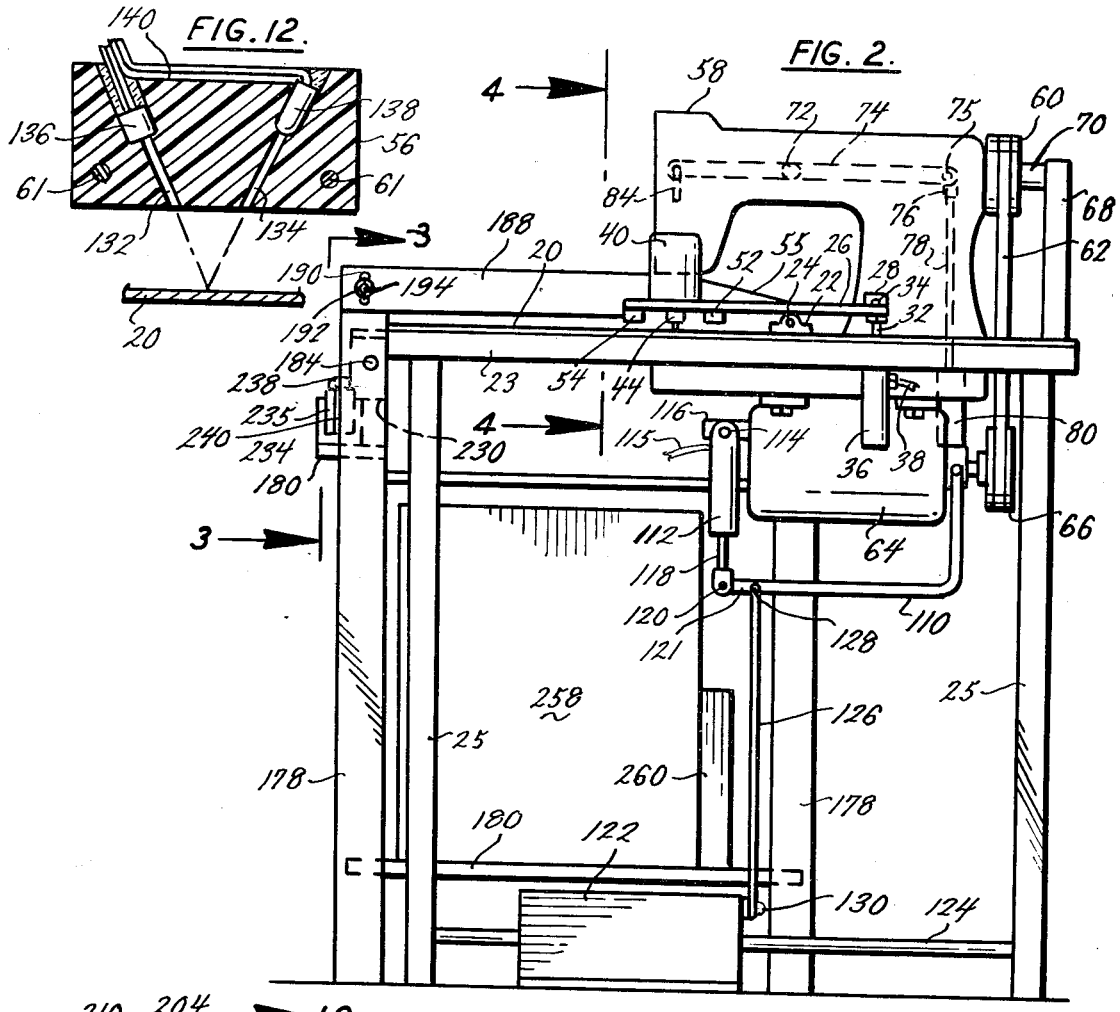
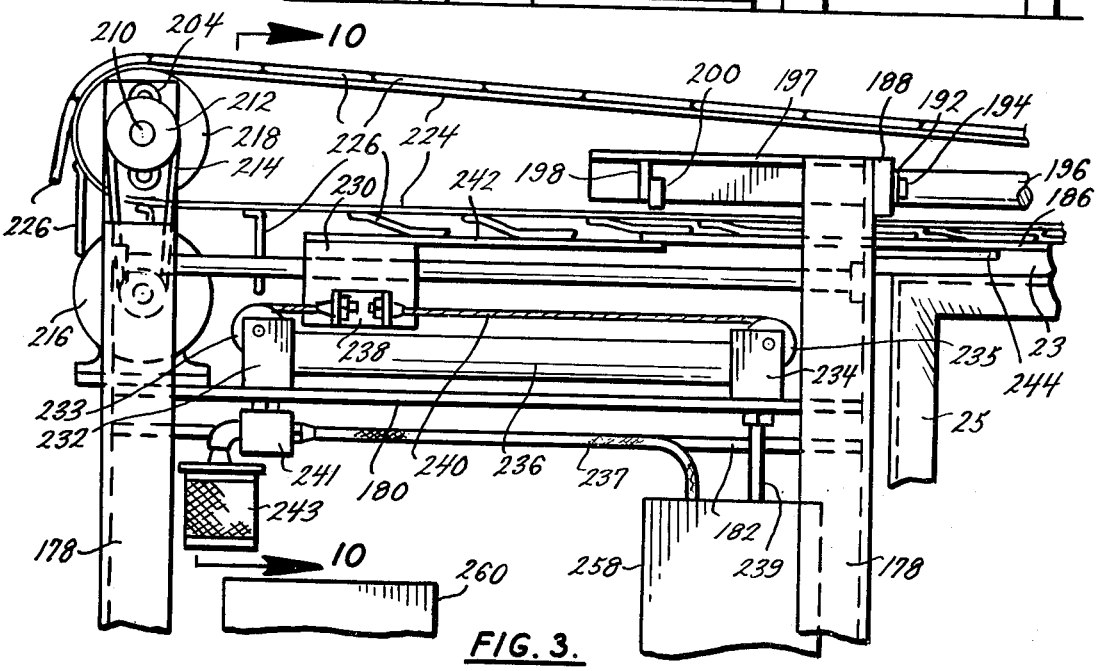
FIG. 3.

FIG. 4.
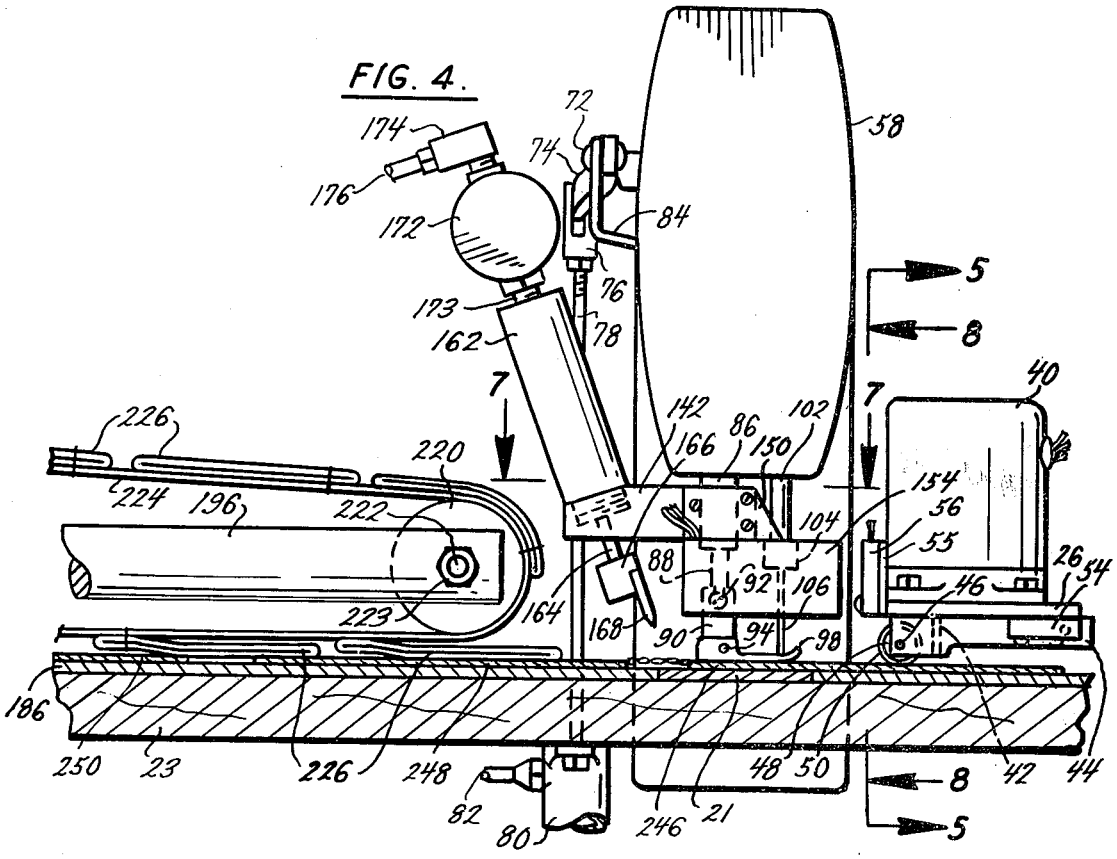
FIG. 5.
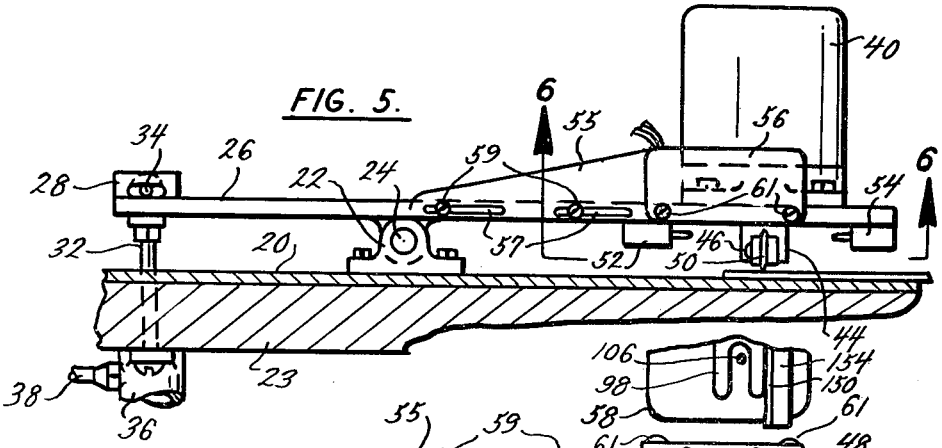
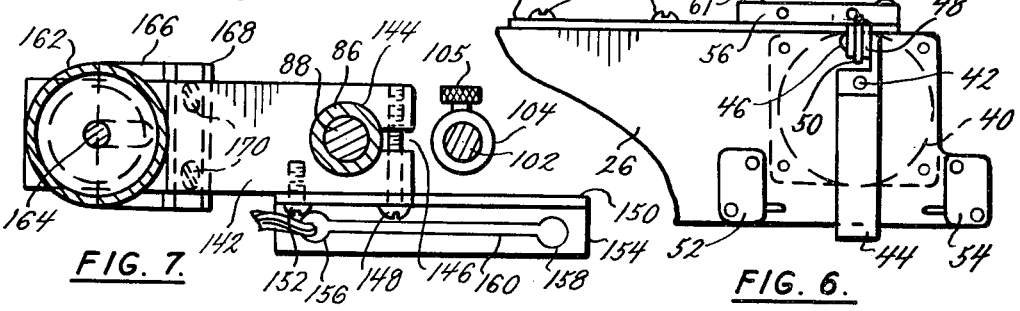
FIG. 7.
FIG. 6.

+12 V
320
324
326
322

AIR CONTROLLING SOLENOID
SOLENOID DRIVER
MONOSTABLE MULTIVIBRATOR
COUNTER
HALL EFFECT SWITCH
MAGNET
FLIP FLOP
AIR CONTROLLING SOLENOID
SOLENOID DRIVER
AMPLIFIER
PHOTO TRANSISTOR
AIR CONTROLLING SOLENOID
SOLENOID DRIVER
MONOSTABLE MULTIVIBRATOR
AMPLIFIER
PHOTO TRANSISTOR
+5V
-5V
+1.5V
-1.5V
+5V
+5V
54
52
266
40
264
268
270
272
274
275
276
277
278
282
136
173
172
162
324
326
292
290
288
286
284
297
296
298
300
112
115
80
82
36
38
301
303
239
236
241
243
237
310
308
306
304
302

GUIDING, STITCHING AND DELIVERING SYSTEM

This is a division of application Ser. No. 458,570 filed Apr. 8, 1974, now U.S. Pat. No. 3,986,467.

FIELD OF THE INVENTION

Where a number of pieces of material of the same configuration are to be stitched, it is desirable to make the locations of the stitches in those pieces of material as uniform as possible; and hence guidance mechanisms have been proposed which are supposed to guide pieces of material beneath the needles of sewing machines. In addition, it is desirable to automatically cut the stitches which trail from the trailing edges of the stitched pieces of material; and hence it has been proposed to locate automatically operated stitch-cutting mechanisms rearwardly of sewing machines. Moreover, it is desirable to automatically move the stitched and cut pieces of material away from the sewing machines; and and hence delivery mechanisms for stitched and cut pieces of material have been proposed.

SUMMARY OF THE PRESENT INVENTION

The present invention provides a guiding, stitching and delivering system which continuously constrains a piece of material while it guides that piece of material beneath the needle of a sewing machine during the stitching of that piece of material, while that piece of material is stationary during the period of time between the completion of the stitching of that piece of material and the start of the stitching of the next-succeeding piece of material, while the stitches between the trailing edge of that piece of material and the leading edge of that next-succeeding piece of material are being cut, and while that piece of material is being moved to a delivery area. More particularly, the present invention provides a guiding, stitching and delivering system which constrains a piece of material as it moves that piece of material beneath the needle of a sewing machine while maintaining a predetermined distance between the stitches formed by that needle and one edge of that piece of material, applies constraining forces to that piece of material while that piece of material is being stitched, continues to applying constraining forces to that piece of material while the sewing machine comes to rest as the stitching of that piece of material is completed, continues to apply restraining forces to the stitched piece of material while the sewing machine remains at rest, continues to apply restraining forces to the stitched piece of material as the sewing machine starts stitching a further piece of material which is moved into position adjacent the needle of the sewing machine, continues to apply restraining forces to the stitched piece of material and thereby maintains the stitches between the trailing edge of the stitched piece of material and the leading edge of the further piece of material taut as that further piece of material is being stitched, and applies constraining delivering forces to the stitched piece of material as the stitches between the trailing edge of the stitched piece of material and the leading edge of the further piece of material are cut. It is, therefore, an object of the present invention to provide a guiding, stitching and delivering system which continuously constrains a piece of material as that piece of material is stitched, as that piece of material is held stationary after being stitched, and as that piece of material is being moved toward a delivery area after it has been cut away from a next-succeeding piece of material.

The guiding, stitching and delivering system of the present invention includes a guidance mechanism which coacts with the presser foot of the sewing machine to apply constraining forces to a piece of material while that guidance mechanism is guiding that piece of material beneath the needle of the sewing machine. That system also includes a delivering mechanism which coacts with that presser foot to apply constraining forces to that piece of material while that piece of material is being stitched, and also while that piece of material is being held stationary after it has been stitched and before the stitching of a further piece of material is begun; and that delivering mechanism continues to apply constraining forces to that piece of material while it moves that piece of material to a delivery area. It is, therefore, an object of the present invention to provide a guiding, stitching and delivering system which utilizes a guidance mechanism, the presser foot of a sewing machine, and a delivering mechanism to continuously apply constraining forces to a piece of material.

Other and further objects and advantages of the present invention should become apparent from an examination of the drawing and accompanying description.

In the drawing and accompanying description, two preferred embodiments of the present invention are shown and described; but it is to be understood that the drawing and accompanying description are for the purpose of illustration only and do not limit the invention and that the invention will be defined by the appended claims.

BRIEF DESCRIPTION OF THE DRAWING

In the drawing,

FIG. 2 is a front elevational view, on a smaller scale, of the guiding, stitching and delivering system of FIG. 1.

FIG. 3 is an elevational view, on the scale of FIG. 1, of the left-hand side of the rear portion of the guiding, stitching and delivering system of FIG. 1.

FIG. 4 is a sectional view, on a still larger scale, through the guiding, stitching and delivering system of FIG. 1, and it is taken along the plane indicated by the line 4—4 in FIG. 2, FIG. 5 is a sectional view, on the scale of FIG. 4, through the guiding, stitching and delivering system of FIG. 1, and it is taken along the plane indicated by the line 5—5 in FIG. 4, FIG. 6 is another sectional view, on the scale of FIG. 4, through the guiding, stitching and delivering system of FIG. 1, and it is taken along the plane indicated by the line 6—6 in FIG. 5, FIG. 7 is a sectional view, on an even larger scale, through the guiding, stitching and delivering system of FIG. 1, and it is taken along the plane indicated by the line 7—7 in FIG. 4, FIG. 12 is a vertical section, on the scale of FIG. 3, through the mounting block for the guiding portion of the guiding, stitching and delivering system of FIG. 1.

DETAILED DESCRIPTION OF COMPONENTS OF PREFERRED EMBODIMENT OF FIGS. 1–14

Figure 8:
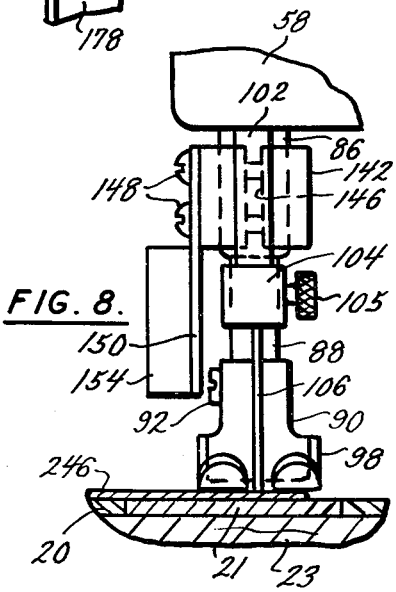
FIG. 8 is a sectional view, on the scale of FIG. 7, through the guiding, stitching and delivering system of FIG. 1, and it is taken along the plane indicated by the line 8—8 in FIG. 4.
Figure 9:
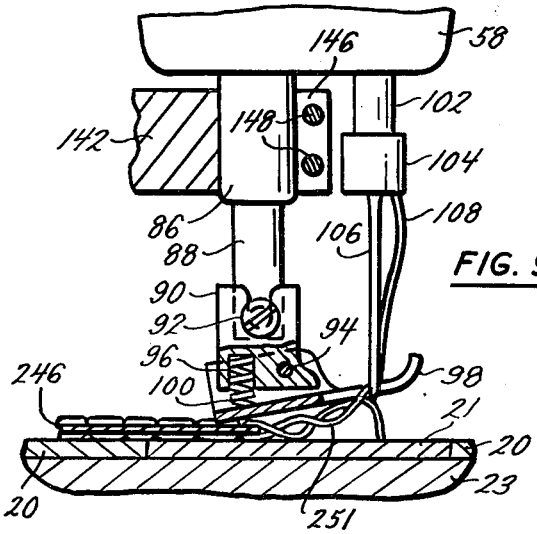
FIG. 9 is a partially-sectioned side elevational view, on the scale of FIG. 7, through the portion of the guiding, stitching and delivering system which is shown in FIG. 8, but it shows the presser foot in its raised position.

Referring to FIGS. 1–14 in detail, the numeral 20 denotes a platform which constitutes the sewing surface of a commercially-available industrial-type sewing machine 58. The numeral 21 denotes a hardened steel insert which is disposed within a recess in the platform 20, as indicated particularly by FIGS. 4, 8 and 9. The leading edge of that hardened steel insert is disposed forwardly of the leading edge of the presser foot 98 of the sewing machine 58, and the trailing edge of that hardened steel insert is located rearwardly of the trailing edge of that presser foot; all as shown by FIG. 9. The hardened steel insert 21 extends laterally beyond both sides of the presser foot 98, as shown by FIG. 8. That hardened steel insert has a slot, not shown, therein which accommodates the needle 106 of the sewing machine 58; and that hardened steel insert also has further slots, not shown, which accommodate the feed dogs, not shown, of that sewing machine. The upper surface of the hardened steel insert 21 is flush with the upper surface of the platform 20, as shown by FIGS. 4, 8 and 9. A support 23 underlies and reinforces the platform 20; and legs 25 extend vertically downwardly from that support to hold that platform at a convenient height above the floor.

The numeral 72 denotes a pivot at the rear of the sewing machine 58; and an elongated lever 74 is rotatably mounted on that pivot. A connecting rod 78 has a clevis-like connector 76 at the upper end thereof; and the right-hand end of the elongated lever 74 is disposed within that clevis-like connector—as that elongated lever is viewed in FIG. 2. A pin 75 passes through the clevis-like connector 76 and through the right-hand of the elongated lever 74 to interconnect the connecting rod 78 with that elongated lever. A link 84 connects the other end of the elongated lever 74 to the mechanism of the sewing machine 58 which can selectively raise and lower the presser foot 98.

The numeral 86 denotes a stationary sleeve which extends downwardly from the sewing machine 58, as indicated particularly by FIGS. 6, 8 and 9; and that stationary sleeve surrounds the vertically-movable support 88 for the presser foot 98.

The numeral 102 denotes the vertically-movable support for the needle 106 of the sewing machine 58. A chuck 104 is provided at the lower end of that vertically-movable support; and a screw 105 can selectively cause that chuck to hold or release the needle 106. The numeral 108 denotes a thread which extends downwardly from a spool, not shown, which is associated with the sewing machine 58; and that thread is threaded through the eye of the needle 106.

The numeral 110 denotes the brake-clutch lever of the motor 64 of the sewing machine 58; and that brake-clutch lever has an elongated horizontally-directed portion, as shown particularly by FIG. 2. A connecting rod 126 has the upper end thereof pivotally secured to the brake-clutch lever 110 by a pin 128; and it has the lower end thereof pivotally secured to the treadle 122 of the sewing machine 58 by a pin 130. That treadle is rotatably supported by an elongated pivot 124 which is horizontally directed and which is close to the floor.

The sewing machine 58, its platform 20, its hardened steel insert 21, its angle irons 23, and its legs 25 are commercially-available items and are not, per se, parts of the present invention. Similarly, the pivot 72, the elongated lever 74, the pin 75, the clevis-like connector 76, the connecting rod 78, the link 84, the stationary sleeve 86, the vertically-movable support 88 for the presser foot 98, that presser foot, the vertically-movable support 102 for the needle 106, that needle, the chuck 104 and its screw 105, the brake-clutch lever 110, the connecting rod 126, and the pins 128 and 130 are commercially-available components of the sewing machine 58 and are not, per se, parts of the present invention.

The numeral 22 denotes a pivot block which is secured to the upper surface of the platform 20, as shown particularly by FIG. 5; and a pivot 24 is held by that pivot block. The pivot 24 rotatably secures an elongated flat plate 26 to the platform 20. Slotted blocks 28 are secured to the upper surface of the left-hand end of the elongated flat plate 26, as that plate is viewed in FIG. 5. Those slotted blocks are disposed at opposite sides of a notch 30 in that end of that block, as indicated particularly by FIG. 1. A connecting rod 32 has the upper end thereof extending upwardly through the notch 30 and disposed between the slotted blocks 28; and a pin 34 connects that upper end of that connecting rod with those slotted blocks. The slots in the slotted blocks 28 obviate any binding of the pin 34 against those slotted blocks when the plate 26 rotates about the pivot 24. The lower end of the connecting rod 32 is connected to a piston, not shown, within a vertically-directed cylinder 36 which is secured to one of the angle irons 23. The numeral 38 denotes a small pipe or tube which can supply compressed air to the cylinder 36.

The numeral 40 denotes a stepping motor which has an output shaft 42 that extends downwardly through an opening, not shown, in the plate 26. Although various stepping motors could be used, an SS25 SLO-SYN synchronous stepping motor manufactured by the Superior Electric Company has been found to be very useful. A crank arm 44 is secured to the lower end of the output shaft 42, as indicated by FIG. 6; and a horizontally-directed pivot 46 rotatably secures a guide wheel 48 to that crank arm. That guide wheel has a soft tire 50 of rubber or some other elastomeric material which can engage a cloth object which is to be stitched. The numerals 52 and 54 denote limit switches which are secured to the lower surface of the plate 26, as indicated particularly by FIGS. 5 and 6; and the actuators of those limit switches can be engaged by the free end of the crank arm 44.

Whenever the cylinder 36 is devoid of compressed air, the combined weights of the stepping motor 40, of the crank arm 44, of the limit switches 52 and 54 and of the guide wheel 48 will hold the tire 50 of that guide wheel down against the platform 20. However, whenever compressed air is supplied to that cylinder, the tire 50 will be raised a short distance, preferably between 20 thousandths and 30 thousandths of an inch, above that platform. Although the resulting spacing of that tire above that platform is small, it is large enough to readily accomodate a piece of cloth which has one edge thereof folded thereunder.

The numeral 55 in FIGS. 1 and 4–6 denotes a bracket of trapezoidal form which is secured to the rear edge of the plate 26. Horizontally-directed slots 57 are provided in that bracket adjacent the lower edge thereof; and screws 59 extend through those slots to seat in threaded sockets within the rear edge of the plate 26. The numeral 56 denotes a mounting block which is secured to the trapezoidal bracket 55 by screws 61; and that mounting block can be set at different positions relative to the output shaft 42 of the stepping motor 40 by loosening the screws 59 and shifting the trapezoidal bracket 55 relative to the plate 26 before re-tightening those screws.

The numeral 60 denotes a pulley which is mounted on the shaft of the sewing machine 58; and a belt 62 passes around that pulley and also around a pulley 66 which is mounted on the output shaft of the motor 64. Whenever the motor 64 is energized at a time when the brake-clutch lever 110 is in its "clutching" position, the pulleys 66 and 60 and the belt 62 will cause the needle 106 of the sewing machine 58 to stitch.

The numeral 68 denotes a support which extends upwardly from the platform 20; and the upper end of that support holds a housing 70 in close proximity to the pulley 60 of the sewing machine 58. A Hall Effect Switch 286 is disposed within the housing 70; and a permanent magnet 284 is mounted within a socket, not shown, in the pulley 60. Each time that pulley makes a revolution, the Hall Effect Switch 286 will develop an output pulse. Although different Hall Effect Switches could be used, a Minneapolis Honeywell 1SS1 Hall Effect Switch has been found to be very useful.

The lower end of the connecting rod 78 in FIGS. 2 and 4 extends to a piston, not shown, within a vertically-directed cylinder 80. That cylinder is located below the level of the platform 20, as indicated particularly by FIG. 4; and a pipe or tube 82 can supply compressed air to that cylinder. That compressed air will act through the connecting rod 78, the elongated lever 74, and the link 84 to raise the vertically-movable support 88 for the presser foot 98.

A mounting bracket 90 for the presser foot 98 is shown particularly by FIGS. 8 and 9; and that mounting bracket is releasably secured to the vertically-movable support 88 by a screw 92. A pivot 94 rotatably secures the presser foot 98 to the vertically-movable support 88 as shown particularly by FIG. 9. A socket 96 extends upwardly from the bottom surface of the mounting block 90; and a helical compression spring 100 has the upper end thereof disposed within that socket and has the lower end thereof bearing against the rear edge of the presser foot 98. That helical compression spring will cause that presser foot to assume the position shown by FIG. 9 whenever compressed air is admitted to the cylinder 80 to cause the connecting rod 78, the elongated lever 74, and the link 84 to raise that presser foot. However, that helical compression spring will yield to permit the presser foot 98 to assume the horizontal position indicated by FIG. 8 whenever the compressed air is vented from the cylinder 80 to permit that presser foot to move to its lower position.

An air cylinder 112, which has a clevis-like upper end, is pivotally secured to a projection 116 on the housing of the motor 64 by a pin 114. A connecting rod 118 has the upper end thereof connected to the piston, not shown, within the cylinder 112; and that connecting rod has the clevis-like lower end thereof connected to an extension 121 on the left-hand end of the brake-clutch lever 110 by a pin 120.

The numeral 132 denotes an inclined passage in the mounting block 56, as shown particularly by FIG. 12; and the upper end of that passage is enlarged to accommodate a photo transistor 136. Although different photo transistors could be used, a Fairchild FPT 102 photo transistor has been found to be very useful. An oppositely-inclined passage 134 also is provided in the mounting block 56, as shown by FIG. 12; and the upper end of that passage is enlarged to accommodate a lamp 138. Although a neon lamp or a light emitting diode could be used as the lamp 138, a long-lived incandescent lamp is preferred; and a Chicago Miniature Filament 2CR incandescent lamp has been found to be very useful. The mounting block 56 is spaced above the platform 20 a distance which enables the light from the lamp 138 to reflect upwardly from that platform and enter the passage 132. The numeral 140 denotes a slot in the upper surface of the mounting block 56 which accommodates the conductors that supply current to the lamp 138.

The numeral 142 denotes a mounting bracket which has a vertically-directed cylindrical recess 144 adjacent one end thereof, as shown by FIG. 7. A slot 146 extends from that cylindrical recess to the adjacent end of that mounting bracket; and screws 148 extend through unthreaded openings in one side of that end of the mounting bracket 142, span the slot 146, and seat in threaded sockets in the other side of that end of that mounting bracket. Those screws can be tightened to cause the mounting bracket 142 to be fixedly clamped to the stationary sleeve 86 which depends downwardly from the sewing machine 58. A mounting plate 150 is secured to, and extends downwardly below the level of and forwardly beyond the leading edge of, the mounting bracket 142, as indicated particularly by FIGS. 4 and 7. A screw 152 and the screws 148, secure that mounting plate to the mounting bracket 142. A mounting block 154, which can be identical to the mounting block 56 of FIG. 12, is suitably secured to the mounting plate 150. The mounting block 154 has an inclined passage 156 which can be identical to the inclined passage 132 in the block 56; and it also has oppositely-inclined passage 158 which can be identical to the inclined passage 134 in the mounting block 56. The mounting block 154 has a slot 160 in the upper surface thereof which can be identical to the slot 140 in the upper surface of the mounting block 56. A photo transistor 293 is mounted in the enlarged upper end of the passage 156; and a lamp, not shown, is mounted in the enlarged upper end of the passage 158. Although different photo transistors could be used, as the photo transistor 293, a Fairchild FPT 102 photo transistor has been found to be very useful. Although a neon lamp or a light emitting diode could be used as the lamp within the enlarged upper end of the passage 158, a Chicago Miniature Filament 2 CR incandescent lamp has been found to be very useful. The mounting block 154 is spaced above the hardened steel insert 21 a distance which enables the light from the lamp therein to reflect upwardly from that hardened steel insert and enter the passage 156 for the photo transistor 293.

The numeral 162 denotes a cylinder which has a threaded lower end; and that lower end is threaded within a threaded socket in the rear end of the mounting bracket 142, as indicated particularly by FIG. 4. The piston 164 of that cylinder has a cutter-holding bracket 166 secured to the lower end thereof; and screws 170, which are shown particularly by FIG. 7, releasably secure a cutter 168 to that cutter-holding bracket. A three-way, spring-return, air-controlling solenoid 172 is secured to the upper end of cylinder 162 by a nipple 173, as shown by FIG. 4; and a fitting 174 connects a pipe or tube 176 to that air-controlling solenoid. Whenever compressed air is supplied to the pipe or tube 176, the piston 164 will force the cutter 168 downwardly against the upper surface of the rear end of the hardened steel insert 21 to cut any stitches which may be intermediate that cutter and that hardened steel insert.

Figure 1:
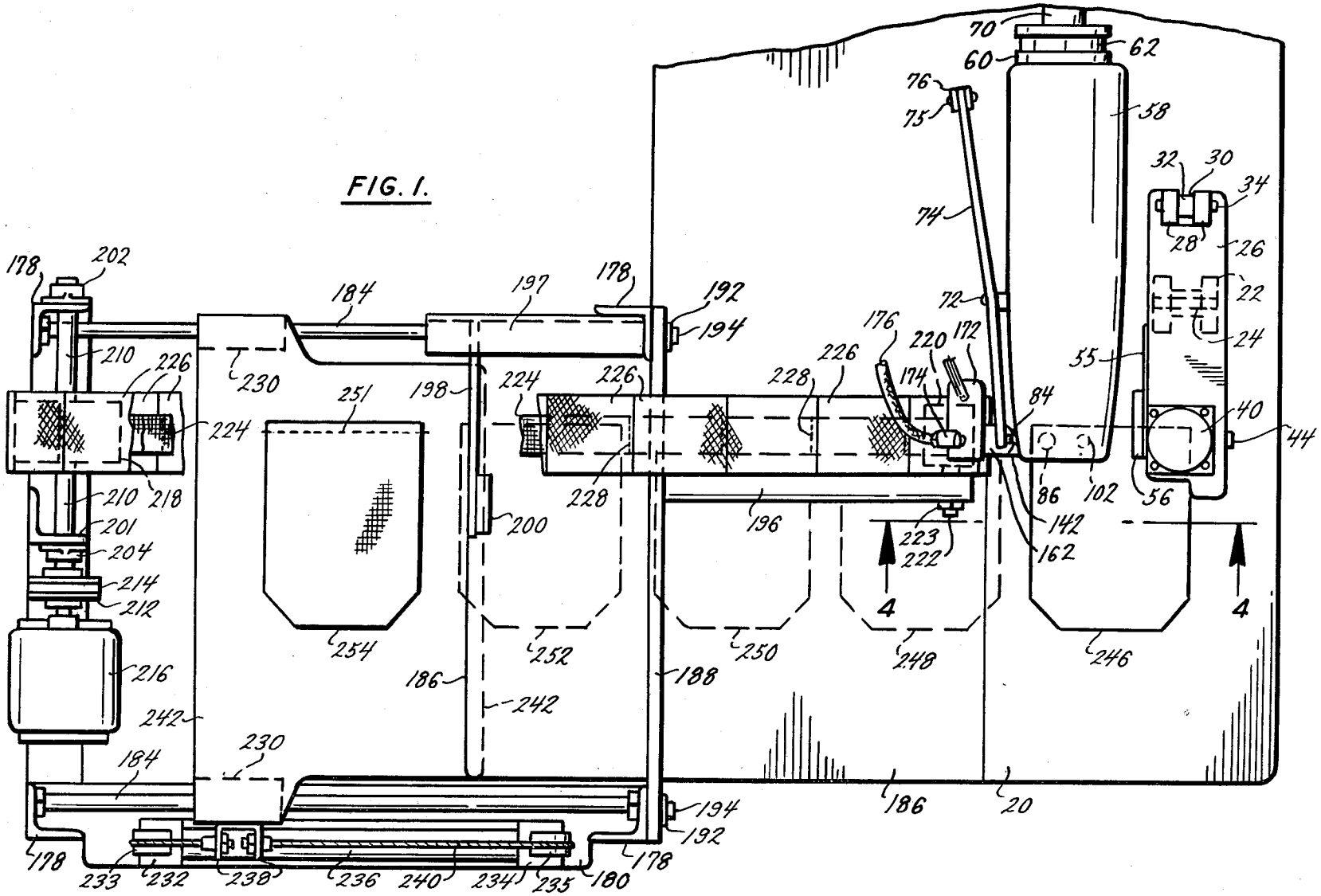
FIG. 1 is a partially broken-away plan view of one preferred embodiment of guiding, stitching and delivering system which is made in accordance with the principles and teachings of the present invention.
Figure 10:
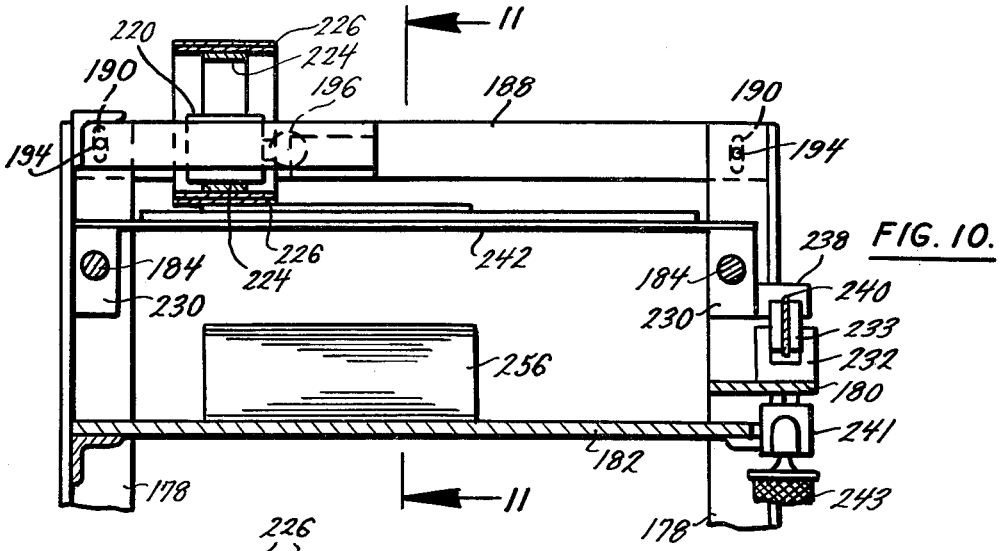
FIG. 10 is a sectional view, on the scale of FIG. 3, through the guiding, stitching and delivering system of FIG. 1, and it is taken along the plane indicated by the line 10—10 in FIG. 3.

The numeral 178 denotes the legs of a stacker frame which is located immediately rearwardly of the frame for the sewing machine 58. Horizontal braces 180 interconnect the legs 178 of that stacker frame; and a stacking platform 182 is mounted between the legs 178 at a level below the upper ends of those legs, as shown particularly by FIGS. 2, 10, and 11. Guide rods 184, of circular cross section, are disposed adjacent the opposite sides of the stacker frame, as shown by FIGS. 1 and 10; and those guide rods help rigidify that stacker frame, and also serve to confine and support sleeve guides 230. The numeral 186 denotes a stationary supporting plate which has the front edge thereof abutting the rear of the platform 20 of the sewing machine, as indicated particularly by FIGS. 1 and 4. The upper surfaces of that supporting plate and of that platform are flush, so the joint therebetween can not constitute an obstruction to the movement of objects rearwardly across that platform and onto that supporting plate.

Figure 11:
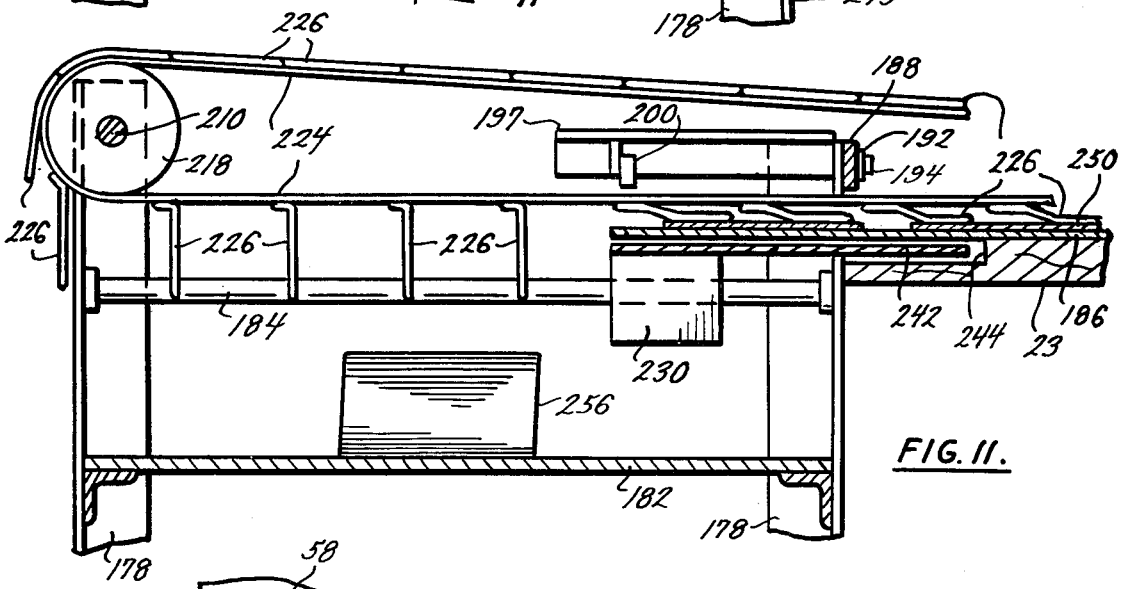
FIG. 11 is a sectional view, on the scale of FIG. 3, through the guiding, stitching and delivering system of FIG. 1, and it is taken along the plane indicated by the line 11—11 in FIG. 10.

The numeral 188 denotes a vertically-adjustable bracket which is rectangular in cross section, as shown particularly by FIG. 11. Vertically-directed slots 190 are provided in the opposite ends of that bracket; and machine screws 194 extend through washers 192 and then through the slots 190 to seat in threaded sockets, not shown, within the upper ends of the two front legs 178 of the stacker frame. An elongated rod 196 of circular cross section is secured to, and extends forwardly from, the bracket 188, as indicated particularly by FIGS. 1 and 3. Loosening of the machine screws 194 permits the bracket 188 to be moved upwardly or downwardly within a range of three-quarters of an inch; and thus permits the forward end of the elongated rod 196 to be moved upwardly and downwardly through that range.

The numeral 197 denotes a brace which is secured to the upper end of the right-hand front leg 178 of the stacker frame; and that brace is horizontally-directed and extends rearwardly from that leg, as shown particularly by FIGS. 1 and 11. A supporting arm 198 extends horizontally inwardly from the brace 197, as indicated particularly by FIGS. 1 and 10; and that supporting arm has a mounting block 200 secured to the front thereof. That mounting block can be identical to the mounting block 56; and it will support a lamp, not shown, and a photo transistor 302.

The numeral 201 denotes a vertically-directed brace which has the form of an angle iron and which is intermediate the rear legs 178 of the stacker frame, as shown particularly by FIG. 1. A pivot block 202 is secured to the right-hand rear leg 178 of the stacker frame, and a pivot block 204 is secured to the brace 201, all as shown by FIG. 1. A shaft 210 is rotatably supported by the pivot blocks 202 and 204; and a pulley 212 is mounted on that shaft. A belt 214 connects that pulley to a pulley, not shown, on the output shaft of a motor 216. A wide-faced pulley 218 also is mounted on the shaft 210; and that pulley will rotate in the clockwise direction in FIG. 11 whenever the motor 216 is energized.

A wide-faced pulley 220 is mounted on a pivot 222 which is held by the forward end of the elongated rod 196, as shown particularly by FIGS. 1 and 4. That pivot has the form of a shouldered bolt; and it is secured to the elongated rod 196 by a nut 223. The lower surface of the pulley 220 will be spaced one-quarter of an inch above the upper surface of the supporting plate 186 whenever the vertically-adjustable bracket 188 is in its lowermost position. The pulley 220 is aligned with the pulley 218; and an endless belt 224, of canvas webbing, passes around both of those pulleys. That belt will be driven by the pulley 218, and it will act to drive the pulley 220. A number of flaps 226 are spaced along the length of the belt 224; and those flaps have the leading edges thereof secured to the belt 224 by rows 228 of stitching which extend transversely of that belt. In the said preferred embodiments of the present invention, each of the flaps 226 is a section of knitted tube which has been pressed flat; and the axes of those sections of knitted tube are transverse to the direction of movement of the belt 224. Because the flaps 226 are very flexible, and because only the leading edges of those flaps are secured to the belt 224, the intermediate and trailing portions of those flaps can sag downwardly and away from the lower "run" of that belt, as shown by FIGS. 3, 4 and 11. The belt 224 is about 1 inch wide, and hence the flaps 226 project outwardly beyond both sides of that belt, as shown by FIGS. 1 and 10. The normal, unstressed thickness of any of those flaps is about one-eighth of an inch.

The numerals 232 and 234 denote pivot blocks which are secured to one of the horizontal braces 180 of the stacker frame, as shown particularly by FIGS. 1 and 3; and the pivot block 232 rotatably supports a pulley 233 while the pivot block 234 rotatably supports a pulley 235. A cable cylinder 236 is mounted on that one horizontal brace, intermediate the pivot blocks 232 and 234; and that cable cylinder preferably is a Tol-A-Matic cable cylinder. The cable 240 of that cable cylinder has the ends thereof passed around the pulleys 233 and 235 and secured to a cable bracket 238; and that cable bracket is secured to the left-hand sleeve guide 230. As a result, actuation of the piston, not shown, within the cable cylinder 236 will cause that cable bracket and that sleeve guide to reciprocate in a direction parallel to the guide rods 184. A movable platform 242 is secured to the sleeve guides 230, and it interconnects those sleeve guides for conjoint movement. The forward end of that movable platform is located just a short distance below the rear edge of the stationary supporting plate 186, and a recess 244 is provided beneath the intermediate portion of that supporting plate to accomodate the front end of that movable platform, all as shown by FIG. 11.

A pipe or tube 239 connects one outlet port of a four-way, spring-return, air-controlling solenoid 310 to one end of the cable cylinder 236; and a pipe or tube 237 and a quick-release valve 241 connect the other outlet port of that air-controlling solenoid to the other end of that cable cylinder. A muffler 243 is connected to the venting port of the quick-release valve 241.

The numeral 258 denotes a housing for the three-way, spring-return, air-controlling solenoid 300, which selectively permits compressed air to pass to the cylinders 36, 80 and 112, and for the air-controlling solenoid 310, which selectively permits compressed air to pass to the cable cylinder 236. The housing 258 is located adjacent the front legs 178 of the stacker frame, as shown particularly by FIG. 3. The numeral 260 denotes a housing for the major portion of the electrical components which are used to control the guiding, stitching, and delivering system of FIGS. 1–14. As shown particularly by FIGS. 2 and 3, the housing 260 is smaller than the housing 258, it is disposed rearwardly of the housing 258, and it is displaced to the right of the housing 258.

The numeral 246 denotes a piece of material which has one edge thereof folded and pressed, and which has the corners of the opposite edge thereof cut away at angles of 45°. That piece of material will have the folded and pressed edge thereof stitched by the guiding, stitching and delivering system of FIGS. 1–14, and then that piece of material will be made part of a stack 256 by that system. Subsequently, that piece of material plus the other pieces of material in that stack will be sewn to garments and will help form pockets for those garments. The numeral 248 denotes a dotted-line position which the piece of material 246 will occupy momentarily after it has been stitched and has had the stitches 251—which trail from the trailing edge of that piece of material—severed by the cutter 168.

The numeral 250 denotes a dotted-line position through which the piece of material 246 will be moved before it is made a part of the stack 256; and the numeral 252 denotes a further dotted-line position through which the piece of material 246 will be moved before it is made a part of the stack 256. The numeral 254 denotes a position to which that piece of material will be moved before the movable platform 242 has been moved far enough fowardly to permit that piece of material to move downwardly and become part of the stack 256.

Figures 13, 14:
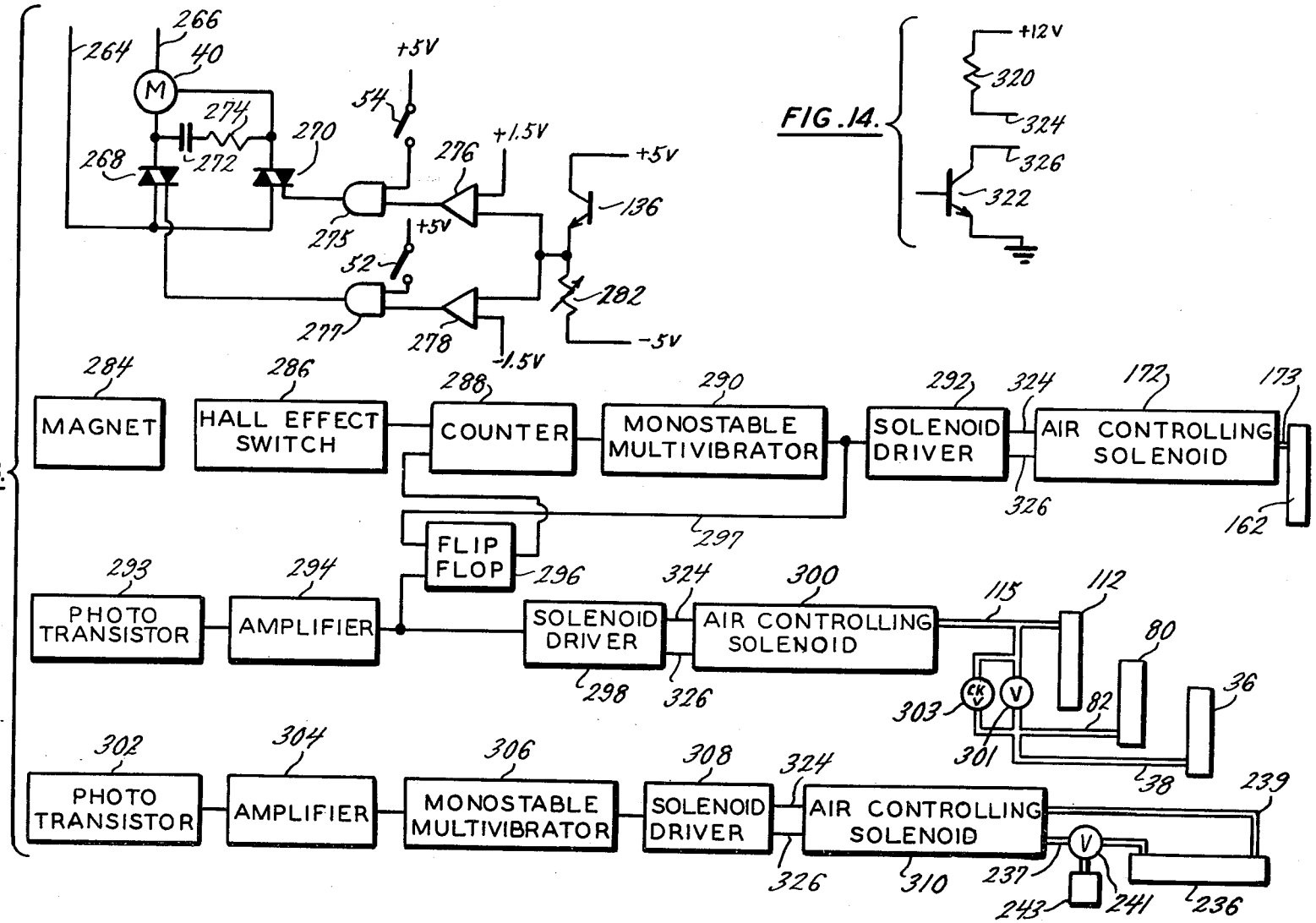
FIG. 13 is a block diagram showing the electrical circuit for the guiding, stitching and delivering system of FIG. 1.
FIG. 14 is a view showing one form of sub-circuit which could be used in each of the Solenoid Driver blocks of FIG. 13.

The numerals 264 and 266 in FIG. 13 denote conductors which are connected to a suitable source of alternating current; and the conductor 266 is connected to one terminal of the stepping motor 40. Another terminal of that motor is connected to one output terminal of a triac 268, and the third terminal of that motor is connected to one output terminal of a triac 270. A capacitor 272 and a resistor 274 are connected in series between the second and third terminals of the motor 40; and the conductor 264 is connected to the other output terminals of both of the triacs 268 and 270. Although various triacs could be used as the triacs 268 and 270, the RCA 40526 triacs have been found to be very useful.

The numeral 275 denotes an AND gate which has the output thereof connected to the gate electrode of the triac 270; and an operational amplifier 276 has the output thereof connected to one input of that AND gate. The limit switch 54 selectively connects the other input of AND gate 275 to a source of plus 5 volts. The numeral 277 denotes an AND gate which has the output thereof connected to the gate electrode of the triac 268; and an operational amplifier 278 has the output thereof connected to one input of that AND gate. The limit switch 52 selectively connects the other input of AND gate 277 to the source of plus 5 volts. Although different AND gates could be used as the AND gates 275 and 277, SN75451A AND gates have been found to be very useful. Similarly, although different operational amplifiers could be used as the operational amplifiers 276 and 278, SN747 operational amplifiers have been found to be very useful.

One input of the operational amplifier 276 is connected to a regulated source of plus 1½ volts; and one input of the operational amplifier 278 is connected to a regulated source of minus 1½ volts. The other inputs of those operational amplifiers are connected together and to the junction between the emitter of the photo transistor 136 and the adjacent terminal of an adjustable resistor 282. The collector of the photo transistor 136 is connected to the source of plus 5 volts, and the other terminal of the adjustable resistor 282 is connected to the source of minus 5 volts. The adjustable resistor 282 can be a one hundred thousand ohm potentiometer which has the movable contact thereof connected to one of the stationary contacts thereof.

The numeral 288 denotes a counter which has one input thereof connected to the Hall Effect Switch 286; and the output of that counter is connected to the input of a monostable multivibrator 290. The numeral 292 denotes a solenoid driver which responds to a signal from the monostable multivibrator 290 to energize the air-controlling solenoid 172 for about 15 milliseconds.

The photo transistor 293 will have the collector thereof directly connected to the source of plus 5 volts and will have the emitter thereof connected to the source of minus 5 volts by an adjustable resistor 282—in the manner in which the collector and emitter of the photo transistor 136 are connected to those sources of 5 volts. The numeral 294 denotes an amplifier which has the input thereof connected to the emitter of photo transistor 293; and the output of that amplifier is connected to the "set" input of a reset-set flip-flop 296 and also to the input of a solenoid driver 298. A conductor 297 connects the output of the monostable multivibrator 290 to the reset input of the flip-flop 296; and the output of that flip-flop is connected to a second input of the counter 288. The numeral 300 denotes an air-controlling solenoid which can selectively supply compressed air to the cylinder 112 via pipe or tube 115, to the cylinder 80 via flow-controlling valve 301 and pipe or tube 82, and to the cylinder 36 via that valve and the pipe or tube 38. The numeral 303 denotes a check valve which is connected in parallel with the flow-controlling valve 301; and that check valve requires all of the compressed air which passes to the cylinders 36 and 80 to pass through that flow-controlling valve, but permits the air which vents from those cylinders to by-pass that flow-controlling valve. As a result, the check valve 303 coacts with the flow-controlling valve 301 to permit the cylinder 112, the connecting rod 118, the brake-clutch lever 110, and the extension 121 on that lever to fully brake the motor 64 before the cylinder 80, the connecting rod 78, the elongated lever 74, the link 84, and the vertically-movable support 88 can raise the leading edge of the presser foot 98 to the position of FIG. 9.

The photo transistor 302 will have the collector thereof directly connected to the source of plus 5 volts and will have the emitter thereof connected to the source of minus 5 volts by an adjustable resistor 282—in the manner in which the collector and emitter of the photo transistor 136 are connected to those sources of 5 volts. The numeral 304 denotes an amplifier which has the input thereof connected to the emitter of photo transistor 302; and the output of that amplifier is connected to the input of a monostable multivibrator 306. A solenoid driver 308 is connected to the output of the monostable multivibrator 306; and the air-controlling solenoid 310 can respond to a signal from that solenoid driver to supply compressed air to the cable cylinder 236 via the pipe or tube 239. The monostable multivibrator 306 will not respond to a negative-going signal from the amplifier 304; but it will respond to a positive-going signal from that amplifier to apply a positive voltage of about 50 milliseconds duration to the solenoid driver 308.

The solenoid drivers 292, 298 and 308 can be made in different ways; but each of those solenoid drivers preferably is made in the manner shown by FIG. 14. Specifically, each of those solenoid drivers preferably includes a one hundred thousand ohm resistor 320 and an NPN transistor 322. One terminal of the resistor 320 will be connected to a source of plus 12 volts, and the other terminal of that resistor will be connected to one terminal of the appropriate one of the air-controlling solenoids 172, 300 and 310 by a conductor 324. The emitter of the transistor 322 will be grounded; and the collector of that transistor will be connected to the other terminal of the appropriate one of the air-controlling solenoids 172, 300 or 310 by a conductor 326. The base of the transistor 322 of the solenoid driver 292 will be connected to the output of the monostable multivibrator 290, the base of the transistor 322 of the solenoid driver 298 will be connected to the output of the amplifier 294, and the base of the transistor 322 of the solenoid driver 308 will be connected to the output of the monostable multivibrator 306; and each of those bases will respond to a positive pulse to render its transistor conductive. The coils of the air-controlling solenoids 172, 300 and 310 have 6 volt ratings; but the solenoid drivers 292, 298 and 308 will, whenever the transistors 322 thereof are rendered conductive, apply voltages to those coils which are larger than 6 volts but are smaller than 12 volts. As a result the plungers of the air-controlling solenoids 172, 300 and 310 will promptly move to fully actuated positions whenever the solenoid drivers 292, 298 and 308 are actuated.

The counter 288 can be a commercially-available analog counter or a commercially-available digital counter. Although different monostable multivibrators could be used as the monostable multivibrators 290 and 306, the two sections of a 74221 dual monostable multivibrator circuit have been found to be very useful. The amplifiers 294 and 304 are operational amplifiers of standard and usual design, and they preferably will be parts of an integrated circuit. The flip-flop 296 is a reset-set flip-flop of standard and usual design.

The motor 216 of FIG. 3 will be energized whenever the guiding, stitching and delivering system of FIGS. 1–14 is "on"—regardless of whether that system is in its "standby" mode or is in its "operating" mode. This means that the widefaced pulleys 218 and 220 will cause the belt 224 to move the lower "run" thereof in the rearward direction throughout the entire time that guiding, stitching and delivering system is "on". That lower run will cause each successive flap 226 to move rearwardly along that "run" and to apply frictional forces to any object or piece of material which the trailing edge of that flap engages.

Prior to the time a piece of material 246 is introduced into the guiding, stitching, and delivering system, the intermediate portions and trailing edges of the flaps 226 will droop downwardly into engagement with the upper surface of the supporting plate 186 as those flaps move downwardly around the wide-faced pulley 220; and those intermediate portions and trailing edges will apply frictional forces to that upper surface as those flaps move from right to left in FIGS. 1 and 4. As the intermediate portions and trailing edges of the flaps 226 successively move rearwardly of the rear edge of the supporting plate 186, those intermediate portions and trailing edges will droop downwardly into engagement with the upper surface of the movable plaform 242; and those intermediate portions and trailing edges will apply frictional forces to that upper surface as those flaps continue to move from right to left in FIGS. 1 and 4. The frictional forces which the flaps 226 apply to the upper surface of the supporting plate 186 and to the upper surface of the movable platform 242 will be insufficient to cause the motor 216 to stall; and that motor will continue to cause those flaps to move from right to left in FIGS. 1 and 4 along the lower "run" of the belt 224.

As each piece of material 246 is being stitched, the leading edge of that piece of material will move into position where the flaps 226 can engage that leading edge and can thereby apply rearwardly-directed frictional forces to that piece of material. Those rearwardly-directed frictional forces will urge that piece of material toward the dotted-line position 248; but, until the stitching of that piece of material has been completed and until the stitches 251 which trail from the trailing edge of that piece of material have been cut, the rate at which that piece of material is moved toward that dotted-line position can not be permitted to exceed the rate at which the feed dogs of the sewing machine 58 advance that piece of material beneath the needle 106. The present invention makes it possible to adjust the values of the rearwardly-directed frictional forces which the flaps 226 apply to the pieces of material 246 so those frictional forces can keep each piece of material 246 flat as it is being stitched, so those frictional forces do not pull any piece of material 246 through the sewing machine 58 at a rate of speed greater than that set by the feed dogs of that sewing machine, so those frictional forces do not move away piece of material 246 rearwardly at a time when that piece of material should be held stationary, so those frictional forces do not affect the form and effectives of the stitches formed by the sewing machine 58, and so those frictional forces do not affect the operator's "feel" of the stitching operation. Specifically, the values of the frictional forces which the flaps 226 can apply to the pieces of materials 246 can be adjusted by adjusting the distance between the supporting table 186 and the wide-faced roller 220—as by adjusting the vertical position of the vertically-adjustable bracket 188, and hence the vertical position of the elongated rod 196.

In the preferred embodiment of FIGS. 1–14, the feed dogs of the sewing machine 58 can move the piece of material 246 beneath the needle 106 at a maximum speed of 400 inches per minute; and the motor 216 and the wide-faced pulleys 218 and 220 will move the flaps 226 rearwardly at a speed of about 600 inches per minute. This means that the flaps 226 will apply sliding friction, rather than static friction, to any piece of material 246 during the time that piece of material is being stitched, as well as during the time that piece of material comes to rest when the sewing machine 58 is braked and is thereby brought to rest.

Detailed Description of "Standby" mode of Preferred Embodiment of FIGS. 1–14: In the "standby" mode of the guiding, stitching and delivering system of FIGS. 1–14, each of the photo transistors 136, 293 and 302 will be receiving so much reflected light that it will be conducting current at the saturation level. As a result, the photo transistor 136 will be applying a plus voltage of about 5 volts to the lower input of operational amplifier 276 and to the upper input of operational amplifier 278; and, similarly, the photo transistor 293 will be applying a plus voltage of about 5 volts to the input of amplifier 294, while the photo transistor 302 will be applying a plus voltage of about 5 volts to the input of amplifier 304. Operational amplifier 276 will be applying a plus voltage to the lower input of AND gate 275; and, for a short time after the guiding, stitching and delivering system began operating in its "standby" mode, the limit switch 54 was applying a plus voltage to the upper input of that AND gate. Consequently, the triac 270 was rendered conductive, and caused the motor 40 to rotate the crank arm 44 in the clockwise direction in FIG. 1—and hence in the counter-clockwise direction in FIG. 6. That rotation of that crank arm continued until that crank arm engaged the actuator of limit switch 54 and thereby opened that limit switch; and, thereupon, the AND gate 275 stopped supplying a signal to the gate electrode of triac 270, and that crank arm came to rest. All of this means that whenever the guiding, stitching and delivering system is in its "standby" mode, the guide wheel 48 will be in its most counter clockwise position—as that guide wheel is viewed in FIG. 6.

The plus voltage which the photo transistor 293 is applying to the input of the amplifier 294 will be causing that amplifier to apply plus voltages to the "set" input of flip-flop 296 and to the base of transistor 322 of the solenoid driver 298. That flip-flop will be applying an "enable" signal to the counter 288; and hence that counter will be able to count any pulses which the Hall Effect Swtich 286 subsequently applies to it. The solenoid driver 298 will be holding the air-controlling solenoid 300 energized; and the resulting application of compressed air to the cylinders 36, 80 and 112 will be holding the guide wheel 48 up out of engagement with the platform 20, will be holding the leading edge of the presser foot 98 in the raised position shown by FIG. 9, and will be holding the brake-clutch lever 110 in motor-braking position. All of this means that whenever the guiding, stitching and delivering system is in its "standby" mode, the needle 106 will be stationary, and the guide wheel 48 and the leading edge of the presser foot 98 will be in their raised positions to permit a piece of material to be moved into position therebeneath.

The plus voltage which the photo transistor 302 is applying to the input of the amplifier 304 will be causing that amplifier to apply a plus voltage to the monostable multivibrator 306; but that monostable multivibrator will have "timed out", and hence will be applying a negative voltage to the base of transistor 322 of the solenoid driver 308. Consequently, that solenoid driver will not be holding the air-controlling solenoid 310 energized; and the resulting application of compressed air to the left-hand end of the cable cylinder 236, via the pipe or tube 237 and the quick-release valve 241, will cause that cable cylinder to hold the movable platform 242 in the rear position shown by FIGS. 1 and 3. All of this means that whenever the guiding, stitching and delivering system is in its "standby" mode, the movable platform 242 will be in position above, and in register with, the supporting platform 182.

The counter 288 will be in its "enabled" condition—so it can respond to pulses which the Hall Effect Switch 286 will subsequently apply to it; and, in that condition, that counter will not be applying a signal to the monostable multivibrator 290. As a result, that monostable multivibrator will not be applying a positive voltage to the solenoid driver 292; and hence that solenoid driver will permit the air-controlling solenoid 172 to be de-energized and thereby keep the cylinder 162 devoid of compressed air. The returning spring within that cylinder will be holding the cutter 168 out of engagement with the hardened steel insert 21, as shown by FIG. 4.

Detailed Description of Operation of Preferred Embodiment of FIGS. 1–14; To initiate an operation of the guiding, stitching and delivering system of FIGS. 1–14, the operator will lay a piece of material 246 on the platform 20 so that portion of the folded edge of that piece of material which is to be stitched will be in register with the needle 106. That operator then will insert the leading edge of that piece of material beneath the tire 50 of the raised guide wheel 48 and will move that leading edge into position beneath the raised leading edge of the presser foot 98. As that operater moves the leading edge of that piece of material into position beneath the leading edge of that presser foot, she will guide the folded edge of that piece of material into position to intercept the light which the platform 20 normally receives from the lamp 138 in the mounting block 56 and normally reflects back up to the photo transistor 136 within that mounting block. As that folded edge intercepts that light, the amount of light which reaches the photo transistor 136 will be substantially reduced; and the resulting decrease in conductivity of that photo transistor will cause the voltage at the emitter of that photo transistor to become less positive. The operator will move the folded edge of the piece of material 246 far enough to cause the voltage at that emitter to become more negative than minus $1\frac{1}{2}$ volts; and, thereupon, the operational amplifier 278 will apply a positive voltage to the lower input of AND gate 277. That positive voltage will coact with the positive voltage which the limit switch 52 is applying to the upper input of that AND gate to cause that AND gate to apply a signal to the gate electrode of the triac 268. That triac will energize the stepping motor 40, and will cause that stepping motor to start rotating the crank arm 44 in the counter clockwise direction in FIG. 1, and hence in the clockwise direction in FIG. 6. The resulting re-closing of the limit switch 54 will not be effective at this time, because the AND gate 275 must have positive voltages at both inputs thereof before it can apply a signal to the gate electrode of the triac 270. The crank arm 44 will start rotating in the counter clockwise direction in FIG. 1 even before the leading edge of the piece of material 246 moves into position to intercept the light which the platform 20 normally receives from the lamp, not shown, within the mounting block 154 and normally reflects back up to the photo transistor 293 within that mounting block; but that rotation will not apply any forces to that piece of material because the tire 50 of the guide wheel 48 is still being held up out of engagement with that platform.

As the leading edge of the piece of material 246 approaches the needle 106, that leading edge will intercept the light which the platform 20 normally receives from the lamp, not shown, within the mounting block 154 and normally reflects back up to the photo transistor 293 within that mounting block; and, thereupon, the voltage at the emitter of that photo transistor will become negative. The amplifier 294 will respond to that negative voltage to remove the positive voltages which it had been applying to the "set" input of flip-flop 296 and to the solenoid driver 298 during the "standby" mode of the guiding, stitching and delivering system of FIGS. 1–14. The removal of the positive voltage from the "set" input of flip-flop 296 will not have any effect at this time, and that flip-flop will continue to apply an "enable" signal to the counter 288; but the removal of the positive voltage from the solenoid driver 298 will cause that solenoid driver to permit the air-controlling solenoid 300 to become de-energized. The check valve 303 and the flow-controlling valve 301 will rapidly vent the compressed air within the cylinders 36, 80, and 112 to the atmosphere. As a result, the cylinder 36 will permit the combined weights of the stepping motor 40, of the crank arm 44, of the guide wheel 48 and of the tire 50 to move that tire down into engagement with the piece of material 246, the cylinder 80 will permit the leading edge of the presser foot 98 to move down into engagement with the leading edge of that piece of material, and the cylinder 112 will permit the brake-clutch lever 110 to assume whatever position the position of the treadle 122 requires that lever to assume.

If, at the time the tire 50 of the guide wheel 48 moves down into engagement with the piece of material 246, the folded edge of that piece of material is blocking one-half of the spot of light which the light from the lamp 138 within the mounting block 56 normally forms on the platform 20, the crank arm 44 will be in, or will be moving toward, the middle position shown by FIGS. 1 and 6. If that folded edge is blocking less than one-half of that spot of light, that crank arm will be in, or will be moving toward, a position between that middle position and the limit switch 54; but if that folded edge is blocking more than one-half of that spot of light, that crank arm will be in, or will be moving toward, a position between that middle position and the limit switch 52.

While the operator moves the leading edge of the piece of material 246 toward the needle 106, she will use her foot to apply a downward force to the treadle 122; but, until that leading edge intercepts the light from the lamp, now shown, within the mounting block 154, the cylinder 112 will hold the brake-clutch lever 110 in braking position. That cylinder will hold that lever in that position regardless of the pressure which the operator's foot applied to that treadle; and hence the sewing machine 58 will not be able to start stitching until the leading edge of the piece of material 246 is in position to be stitched. As the leading edge of the piece of material 246 intercepts the light from the lamp, not shown, within the mounting block 154, the cylinder 112 will release the brake-clutch lever 112; and, thereupon, the treadle 122 will respond to the pressure from the operator's foot to move that brake-clutch lever down to clutching position. Simultaneously, the leading edge of the presser foot 98 will move down to the position of FIG. 8, and the guide wheel 48 will move down into engagement with the piece of material 246. That presser foot will coact with the feed dogs, not shown, of the sewing machine 58 to advance the piece of material 246 past the needle 106; and the tire 50 on the guide wheel 48 will apply a force to that advancing piece of material which will cause the folded edge of that piece of material to intercept one-half of the spot of light formed by the lamp 138 within the mounting block 56.

For example, if the folded edge of the piece of material 246 is intercepting essentially one-half of the spot of light formed by the lamp 138 within the mounting block 56, the crank arm 44 will be in the middle position shown by FIGS. 1 and 6; and the tire 50 of the guide wheel 48 will be parallel to the direction of movement of that piece of material and will not apply any laterally-directed forces to that piece of material. However, if the folded edge of the piece of material 246 is intercepting appreciably less than one-half of the spot of light formed by the lamp 138 within the mounting block 56, the crank arm 44 will be intermediate the limit switch 54 and the middle position shown by FIGS. 1 and 6; and the tire 50 of the guide wheel 48 will by applying a dragging force to that piece of material which will urge that folded edge away from that limit switch, and hence toward the position wherein that folded edge will intercept essentially one-half of that spot of light. On the other hand, if the folded edge of the piece of material 246 is intercepting appreciably more than one-half of the spot of light formed by the lamp 138 within the mounting block 56, the crank arm 44 will be intermediate the limit switches 52 and the middle position shown by FIGS. 1 and 6; and the tire 50 of the guide wheel 48 will be applying a dragging force to that piece of material which will urge that folded edge toward the limit switch 54, and hence toward the position wherein that folded edge will intercept essentially one-half of that spot of light. The guide wheel 48 will quickly move the folded edge of the piece of material 246 into the desired position—that guide wheel usually moving that folded edge into the desired position before the sewing machine 58 has made two stitches.

As shown by FIGS. 4 and 6, the guide wheel 48 is located between the needle 106 and the output shaft 42 of the stepping motor 40; and this is desirable because it enables the tire 50 of that guide wheel to apply guiding forces to the portion of the piece of material 246 which is immediately ahead of the needle 106. As a result, that guide wheel can provide guiding forces for short pieces of material, can maintain the desired spacing between the stitches and an adjacent edge of that piece of material even when that adjacent edge is curved, and can apply guiding forces to each piece of material until shortly before the trailing edge of that piece of material reaches the needle 106.

As the presser foot 98 and the feed dogs of the sewing machine 58 advance that piece of material 246 relative to the needle 106, that needle and the looper of that sewing machine will respond to each revolution of the pulley 60 to make a stitch. Each time that pulley makes a revolution, it moves the magnet 284 past the Hall Effect Switch 286, and thereby causes the Hall Effect Switch to apply a pulse to the counter 288. The speed at which the feed dogs and presser foot 98 of the sewing machine 58 will advance the piece of material 246 will be controlled by the extend to which the operator depresses the rear edge of the treadle 122. This is desirable; because it enables the operator to have full and complete control over the rate of stitching, and it also enables the operator to stop the stitching if the thread breaks, if the supply of thread is exhausted, or if some other contingency arises.

After the sewing machine has made about 12 or 13 stitches in the folded edge of the piece of material 246, the counter 288 will apply a negative-going signal to the input of the monostable multivibrator 290; and that monostable multivibrator will respond to that signal to apply a positive voltage, of about 15 milliseconds duration, to the "reset" input of the flip-flop 296 and also to the input of the solenoid driver 292. That positive voltage will reset that flip-flop, and will thereby cause that flip-flop to remove the "enable" signal which that flip-flop had been applying to the counter 288. As a result, that counter will not count any further impulses from the Hall Effect Switch 287. The duration of the positive voltage, which the monostable multivibrator 290 applies to the "reset" input of the flip-flop 296 and also to the input of the solenoid driver 292, can be adjusted by moving the movable contact of an adjustable resistor which is associated with that monostable multivibrator.

The solenoid driver 292 will respond to the positive voltage from the monostable multivibrator 290 to energize the air-controlling solenoid 172 for about 15 milliseconds; and, during those 15 milliseconds, compressed air will enter the cylinder 162 via the pipe or tube 173. That compressed air will force the cutter 168 downwardly against the hardened steel insert 21 with sufficient force and speed to enable that cutter to sever any stitches which would be intermediate that cutter and that hardened steel insert. However, it it is assumed that the piece of material 246 is the first of a series of pieces of material to be stitched by the sewing machine 58, the downward movement of the cutter 168 will not be meaningful at this time.

At the end of the end of the 15 milliseconds, the solenoid driver 292 will permit the air-controlling solenoid 172 to again become de-energized. Thereupon, the compressed air within the cylinder 162 will be vented to the atmosphere; and the returning spring within that cylinder will promptly move the cutter 168 back up to the raised position of FIG. 4. The period of time during which compressed air is supplied to the cylinder 162 is short enough to keep the cutter 168 from interfering with the advancement of the piece of material 246 through the sewing machine 58, regardless of the speed at which that piece of material is being advanced through that sewing machine.

The sewing machine 58 will respond to pressure on the treadle 122 to stitch and advance the piece of material 246; and the presser foot 98 of that sewing machine will coact with the tire 50 of the guide wheel 48 to constrain that piece of material. In addition, that tire will apply to that piece of material whatever laterally-directed guidance forces are needed to keep the folded edge of that piece of material in position to intercept one-half of the spot of light from the lamp 138 within the mounting block 56. As the sewing machine 58 continues to stitch and advance the piece of material 246, the trailing edge of that piece of material will move rearwardly beyond the tire 50 of the guide wheel 48; and hence that tire will no longer be able to apply constraining forces and laterally-directed guidance forces to that piece of material. In fact, as that trailing edge moves beyond the guide wheel 48, the photo transistor 136 will become illuminated; and the resulting triggering of triac 270 will cause the stepping motor 40 to rotate the crank arm 44 far enough in the clockwise direction in FIG. 1 to open the limit switch 54. Thereupon, that crank arm will come to rest; and it will hold that limit switch open until a further piece of material 246 has the leading edge thereof moved into position to intercept the spot of light from the lamp 138 in the mounting block 56.

Prior to the time the trailing edge of the stitched piece of material 246 moves rearwardly beyond the tire 50 of the guide wheel 48, the leading edge of that piece of material will move into position to be engaged by the flaps 226; and those flaps will coact with the presser foot 98 to apply constraining forces to that piece of material. Further, those flaps will apply forces to that piece of material which will be generally aligned with the feed dogs of the sewing machine 58; and hence those flaps will tend to cause that piece of material to continue to move along the path into which it was guided by the tire 50 of the guide wheel 48. The piece of material 246 will continue to intercept the light from the lamp, not shown, within the mounting block 154 until the trailing edge of that piece of material is immediately adjacent the needle 106; and hence, throughout the time that piece of material is being stitched, the photo transistor 293, the amplifier 294, the solenoid driver 298 and the air-controlling solenoid 300 will keep the cylinders 36, 80 and 112 devoid of compressed air. Consequently, the tire 50 of the guide wheel 48 will be in its lower position, the presser foot 98 will be in the position shown by FIG. 8, and the cylinder 112 will permit the treadle 122 to control the brake-clutch lever 110. However, as the trailing edge of the piece of material 246 approaches the needle 106, that trailing edge will move out of register with the light from the lamp, not shown, within the mounting block 154; and thereupon, light will reach the photo transistor 293 and will cause that photo transistor and the amplifier 294 to apply a positive voltage to the "set" input of the flip-flop 296 and to the solenoid driver 298. That flip-flop will again apply an "enable" signal to the counter 288; and that solenoid driver will again cause the air-controlling solenoid 300 to supply compressed air to the cylinders 36, 80 and 112.

The compressed air which is intended to enter the cylinder 112 will promptly and rapidly flow into that cylinder; but the compressed air which is intended to enter the cylinder 36 and 80 must pass through the flow-restricting valve 301. As a result, the cylinder 112 will promptly act through the connecting rod 118 to raise the brake-clutch lever 110 and thereby cause that lever to apply braking forces to the motor 64; but the guide wheel 48 and the presser foot 98 will momentarily remain in the lower positions shown by FIGS. 2 and 8, respectively.

The compressed air within the cylinder 112 will force the brake-clutch lever 110 to move upwardly to braking position even if the operator maintains an actuating pressure on the treadle 122. As a result, the guiding, stitching, and delivering system of FIGS. 1–14 will automatically and positively halt the operation of the sewing machine 58 as the trailing edge of each piece of material 246 moves rearwardly beyond the spot of light from the lamp, not shown, within the mounting block 154. It is important to note that the delays inherent in the operation of the air-controlling solenoid 300 and of the actuating circuit therefor will coact with the momentum of the rotating parts of the sewing machine 58 to cause the feed dogs of that sewing machine to advance the trailing edge of the piece of material 246 rearwardly beyond the needle 106 a distance corresponding to the lengths of three or four stitches before that sewing machine comes to rest. Those stitches make certain that a finite gap will exist between the trailing edge of the piece of material 246 and the leading edge of the next-succeeding piece of material 246; and that finite gap will enable the cutter 168 to subsequently cut the stitches between, but not cut any portions of, that piece of material and that next-succeeding piece of material. As the sewing machine 58 comes to rest—approximately 45 milliseconds after the photo transistor 293 actuated the amplifier 294—the compressed air within the cylinder 36 will cause the tire 50 of the guide wheel 48 to move upwardly out of engagement with the platform 20, and the compressed air within the cylinder 80 will act through the connecting rod 78, the elongated lever 74, and the link 84 to raise the leading edge of the presser foot 98 to the position of FIG. 9. Because the presser foot 98 will not move from the position of FIG. 8 to the position of FIG. 9 until the feed dogs of the sewing machine 58 have come to rest, that presser foot will coact with those feed dogs to advance the trailing edge of the piece of material 246 rearwardly beyond the needle 106 the required three or four stitches.

As the presser foot 98 moves to the position shown by FIG. 9, the spring 100 will hold the trailing edge of that presser foot down in holding engagement with the trailing edge of the stitched piece of material 246; and hence that presser foot will continue to apply a constraining force to that piece of material. This is important; because the frictional forces which the flaps 226 apply to the stitched piece of material 246 will tend to move that stitched piece of material rearwardly, and those frictional forces could be greater than the holding forces, which the needle 106 and the looping mechanism of the sewing machine 58, could apply to the stitches 251. However, the constraining forces which the trailing edge of the presser foot 98 applies to the trailing edge of the piece of material 246 will be more than adequate to hold that stitched piece of material against movement rearwardly toward the dotted-line position 250 despite the frictional forces which the flaps 226 continuously apply to that stitched piece of material. All of this means that as the trailing edge of the stitched piece of material 246 moves rearwardly beyond the spot of light developed by the lamp, not shown, within the mounting block 154, that stitched piece of material will be brought to rest and will be held flat until the leading edge of the next-succeeding piece of material 246 is moved into position to intercept that spot of light.

When the operator of the sewing machine 58 moves the leading edge of the next-succeeding piece of material 246 into position to intercept the light from the lamp 138 within the mounting block 56, the steping motor 40 will again start moving the crank arm 44 away from the limit switch 54. When that operator thereafter moves that leading edge into position to intercept the light from the lamp, not shown, within the mounting block 154, the guide wheel 48 will move downwardly into engagement with that next-succeeding piece of material, the presser foot 98 will move down to the position of FIG. 8, and the cylinder 112 will permit the position of the treadle 122 to control the position of the brake-clutch lever 110. In addition, the amplifier 294 will remove the positive voltage which it had been applying to the set input of the flip-flop 296; but the removal of that positive voltage will not be significant at this time, because that flip-flop will continue to apply the "enable" signal to the counter 288 until the monostable multivibrator 290 applies a positive voltage to the reset input of that flip-flop. This means that the counter 288 will count each of the stitches which the sewing machine 58 forms in the leading portion of the next-succeeding piece of material 246; and, when the sum of those stitches plus the three or four stitches which were made after the trailing edge of the stitched piece of material 246 moved rearwardly beyond the mounting block 154 reaches 16, that counter will apply a negative-going signal to the monostable multivibrator 290. Thereupon, that monostable multivibrator will apply a positive voltage to the reset input of the flip-flop 296 and to the solenoid driver 292. That positive voltage will reset that flip-flop, and will thereby cause that flip-flop to remove the "enable" signal which it had been supplying to the counter 288; and hence that counter will not count any further stitches which are formed in that next-succeeding piece of material. The positive voltage which the monostable multivibrator 290 applies to the solenoid driver 292 will cause that solenoid driver to energize the air-controlling solenoid 172—with consequent movement of the cutter 168 downwardly against the stitches 251 between the trailing edge of the stitched piece of material 246 and the leading edge of the next-succeeding piece of material 246. Those stitches will be held taut, because the frictional forces which the flaps 226 apply to that stitched piece of material tend to move that stitched piece of material rearwardly at a higher rate of speed than the rate of speed at which the next-succeeding piece of material 246 is being advanced through the sewing machine. Because those stitches are held taut, the cutter 168 will easily and surely sever those stitches and then move back up out of the path of the leading edge of that next-succeeding piece of material.

It is important to note that the sewing machine 58 must start forming stitches in the next-succeeding piece of material 246 before the cutter 168 can be moved downwardly to cut the stitches 251 between the trailing edge of the stitched piece of material 246 and the leading edge of that next-succeeding piece of material 246. By requiring that sewing machine to form such stitches, the present invention minimizes the wearing forces which develop between the presser foot 98 and the hardened steel insert 21 whenever stitching occurs at a time when a piece of material is not underlying that presser foot. Also, by requiring that sewing machine to form such stitches, the present invention keeps the forces, which the needle 106 and the looper of that sewing machine apply to the threads used in forming stitches, from pulling the subsequently formed stitches out of the leading edge of the next-succeeding piece of material 246. In that way, the present invention obviates the problems of missed stitches and of broken threads which could arise if the stitches 251 were to be cut before a number of stitches were made in the leading edge of the next-succeeding piece of material 246. Such problems are particularly frequent and acute where the sewing machine forms chain, rather than lock, stitches and where that sewing machine uses smooth filament-type plastic threads.

After the stitches 151 have been severed, the flaps 226 will rapidly move the severed piece of material 246 through the dotted-line positions 248, 250 and 252 toward the solid-line position 254 in FIG. 1; and those flaps will apply constraining forces to that severed piece of material as they do so. The sewing machine 58 will continue to advance and stitch the next-succeeding piece of material 246; but the rate of advancement of the next-succeeding piece of material will, of course, be substantially less than the rate at which the severed piece of material 246 is moved rearwardly toward the solid-line position 254. This is desirable; because it will move the severed piece of material 246 to the solid-line position 254 while the next-succeeding piece of material 246 is being stitched or is being held short of the dotted-line position 248. As a result, that next-succeeding piece of material will be wholly displaced from the position 254, and thus will not be able to interfere with the stacking of the severed piece of material 246.

As the leading edge of the severed piece of material 246 intercepts the spot of light which is developed by the lamp, not shown, within the mounting block 200, the photo transistor 302 will apply a negative-going signal to the amplifier 304; and that amplifier will remove the positive voltage which it had been applying to the monostable multivibrator 306. Because that monostable multivibrator responds to positive-going signals and does not respond to negative-going signals, the movement of the leading edge of the severed piece of material 246 into register with the mounting block 200 will be unable to cause that monostable multivibrator to apply a positive voltage to the solenoid driver 308. However, as the trailing edge of the severed piece of material 246 moves rearwardly beyond the spot of light which is developed by the lamp, not shown, within the mounting block 200, the photo transistor 302 will apply a positive-going signal to the amplifier 304; and that amplifier will again apply a positive voltage to the monostable multivibrator 306. Thereupon, that monostable multivibrator will apply a positive voltage, of about 50 milliseconds duration, to the solenoid driver 308. That solenoid driver will energize the air-controlling solenoid 310 for approximately 50 milliseconds; and the resulting application of compressed air to the cable cylinder 236 via the pipe or tube 239 will cause the piston, not shown, within that cable cylinder to move from right to left in FIG. 3. Thereupon, the cable 240 and the cable bracket 238 will move the movable platform 242 and its guide sleeves 230 forwardly relative to the guide rods 184. The quick-release valve 241 will permit air to exhaust rapidly from the left-hand end of the cable cylinder 236; and hence the forward movement of the moveable platform can be as rapid as desired. That quick-release valve will direct the exhausting air through the muffler 243; and that muffler will keep the noise made by that exhausting air at an acceptable level.

The flaps 226 will continue to apply rearwardly-directed frictional forces to the severed piece of material 246; and those frictional forces will keep that severed piece of material moving rearwardly despite the forward movement of the movable platform 242. When the rear edge of that movable platform has moved far enough forwardly, relative to the leading portion of the severed piece of material 246, that severed piece of material will fall away from that movable platform and will become a part of the stack 256. The action of the flaps 226 in continuing to apply rearwardly-directed frictional forces to the severed piece of material 246 is important, because those frictional forces will make certain that the said severed piece of material will not move forwardly with the forwardly-moving movable platform 242.

The severed piece of material 246 which forms the bottom of the stack 256 will be located a minute distance further from the sewing machine 58 than will each succeeding piece of material; and each succeeding severed piece of material 246 in that stack will be located a minute distance closer to that sewing machine than is its predecessor severed piece of material. This is due to the fact that as the stack 256 gets taller, the distance through which the severed pieces of material 246 float down onto that stack, and hence the extent of rearward movement of those severed pieces of material, gets smaller. However, the stack 256 is neater, more regular, and more nearly vertical than any stack which a person could make by stacking a number of pieces of material by hand.

The rate at which the cable cylinder 236 moves the movable platform 242 is not critical. As a result, that rate can be made relatively rapid or relatively slow without adversely affecting the neatness, regularity and verticality of the resulting stack 256.

The duration of the positive voltage which the monostable multivibrator 306 applies to the solenoid driver 308 can be adjusted by moving the movable contact of an adjustable resistor which is associated with that monostable multivibrator. In the preferred embodiment of FIGS. 1–14, the duration of the positive voltage provided by the monostable multivibrator 306 is long enough to cause the air-controlling solenoid 310 and the pipe or tube 239 to supply compressed air to the front end of the cable cylinder 236 just long enough to cause the piston, not shown, of that cable cylinder to approach, but not reach, the rear end of that cable cylinder. Such a duration of that positive voltage is desirable; because it means that the compressed air which the air-controlling solenoid 310, the pipe or tube 237, and the quick-release valve 241 will introduce into the rear end of that cable cylinder—as that air-controlling solenoid becomes de-energized after 50 milliseconds—will act as an air cushion to help decelerate and halt the forward movement of the movable platform 242. Subsequently, the compressed air which the pipe or tube 237 and the quick-release valve 241 introduce into the rear end of the cable cylinder 236 will cause the piston, not shown, within that cable cylinder to move toward the front of that cable cylinder, and will thereby cause the movable platform 242 to return to the rear position shown by FIGS. 1 and 3.

It will be noted that the mounting block 200 is located so the light from the lamp, not shown, therein strikes and reflects from the stationary supporting plate 186 and not the movable platform 242. This is desirable; because the point on the stationary supporting plate 186 which reflects that light will always have the same height and same inclination relative to that mounting block, whereas points on the front edge of that movable platform could assume slightly different heights and inclinations relative to that mounting block. Any such slightly different heights and inclinations could change the location of the light spot or the angles of incidence and reflection.

The sewing machine 58 will continue to stitch the next-succeeding piece of material 246 until the trailing edge of that next-succeeding piece of material moves out from under the spot of light provided by the lamp, not shown, within the mounting block 154. At such time, the photo transistor 293 will apply a positive voltage to the amplifier 294 which will enable that amplifier to "set" the flip-flop 296 and to cause the solenoid driver 298 to energize the air-controlling solenoid 300. Thereupon, the sewing machine 58 will permit three or four additional stitches to form before it comes to rest, and then the guide wheel 48 will be raised and the presser foot 98 will be moved to the position of FIG. 9—all as explained in detail heretofore. The counter 288 will count those stitches; but that counter and the sewing machine 58 will remain inactive until the leading edge of yet another piece of material 246 is introduced into the guiding, stitching and guiding system of FIGS. 1–14.

PREFERRED EMBODIMENT OF FIGS. 15 AND 16

Figures 15, 16:
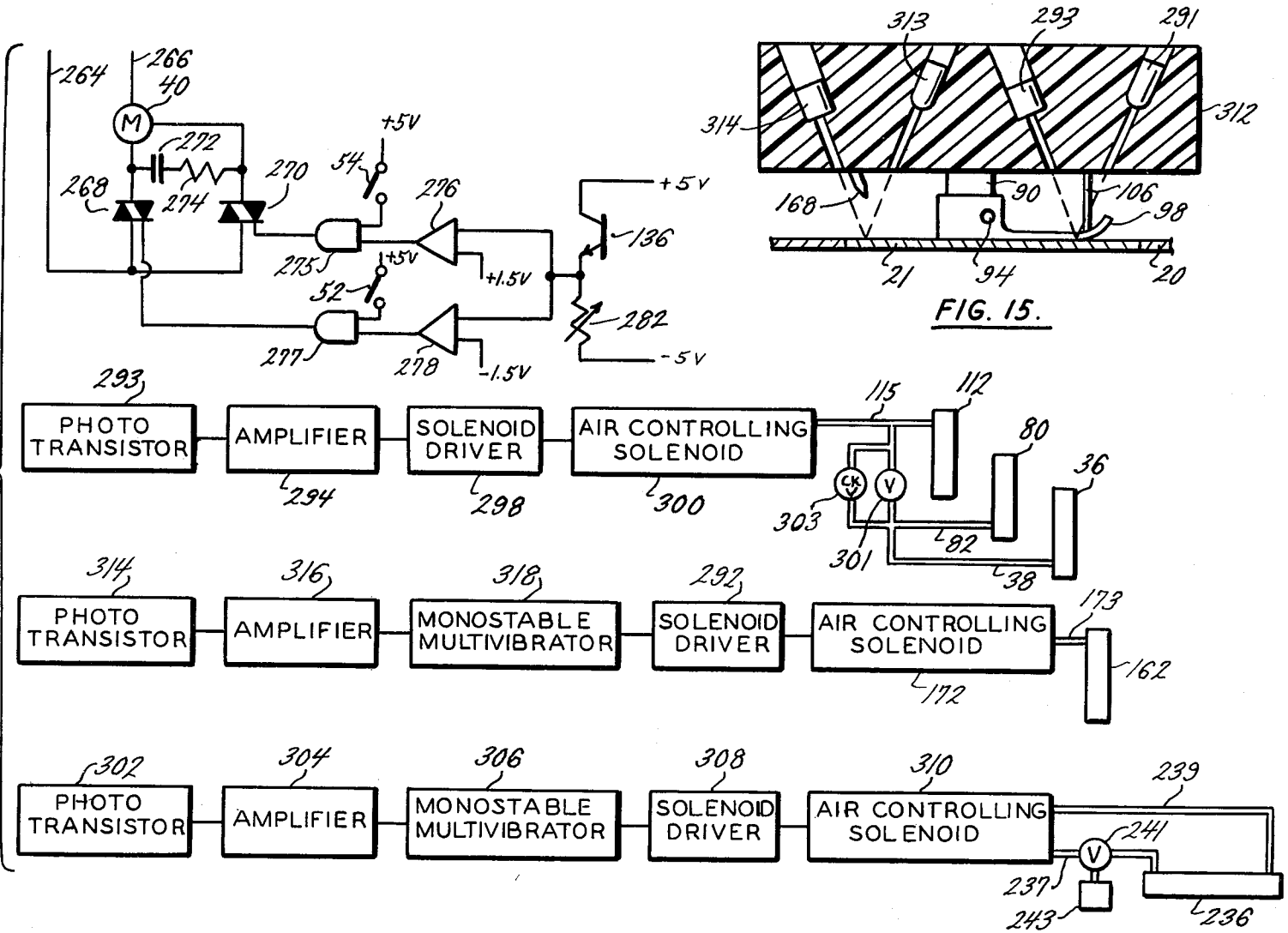
FIG. 15 is a side elevational view of a mounting block which is used in a second preferred embodiment of guiding, stitching, and delivering system which is made in accordance with the principles and teachings of the present invention.
FIG. 16 is a block diagram showing the electrical circuit for the second preferred embodiment of guiding, stitching and delivering system.

Referring particularly to FIG. 15, the numeral 312 denotes a mounting block which is longer than the mounting block 154 of FIG. 7; but the leading edge of the former mounting block will be mounted in the position occupied by the leading edge of the latter mounting block in FIG. 7. The mounting block 312 has four passages therein, as shown by FIG. 15; and one of those passages has a photo transistor 293 mounted in the enlarged upper end thereof. That photo transistor can be identical to the identically-numbered photo transistor in FIG. 13; and the passage in the mounting block 312 which accommodates that photo transistor 293 preferably will be identical to, and will be located in the same relative position as, the corresponding passage 156 in the mounting block 154. A lamp 291 is mounted in the enlarged upper end of a second passage in the mounting 312 which is inclined oppositely to the passage in which the photo transistor 293 is mounted, as shown by FIG. 15. The passage for the lamp 291 preferably will be identical to, and will be located in the same relative position as, the passage 158 in the mounting block 154 of FIG. 7. A further passage in the mounting block 312 has a photo transistor 314 mounted in the enlarged upper end thereof; and that passage is located adjacent the rear of that mounting block. The numeral 313 denotes a lamp which is mounted in the enlarged upper end of a passage which is oppositely inclined to the passage in which the photo transistor 314 is mounted; and the lamp-containing passage is located intermediate the passages in which the photo transistors 314 and 293 are mounted.

As indicated particularly by dotted lines in FIG. 15, the point on the hardened steel insert 21, where the light from the lamp 291 is normally reflected back up into the passage for the photo transistor 293, is located just a very short distance rearwardly of the needle 106. Also as indicated by dotted lines in FIG. 15, the point on that hardened steel insert, where the light from the lamp 313 is normally reflected back up into the passage for the photo transistor 314, is located a short distance rearwardly of the point where the cutter 168 will engage that hardened steel insert. As a result, the trailing edge of each stitched piece of material 246 will move rearwardly of the needle 106 before the photo transistor 293 can develop a positive voltage and thereby cause actuation of the air-controlling solenoid 300; and the trailing edge of that stitched piece of material will move rearwardly beyond the point, where the cutter 168 strikes the hardened steel insert 21, before the photo transistor 314 can develop a positive voltage and can apply that voltage to the input of an amplifier 316.

The actions of the photo transistor 293, of the amplifier 294, of the solenoid driver 298, and of the air-controlling solenoid 300 will, effectively, be the same as the actions of the identically-numbered components of FIG. 13. However, the actions of the photo transistor 314, of the amplifier 316, and of the monostable multivibrator 318 will be different from the actions of the magnet 284, of the Hall Effect Switch 286, of the counter 288, and of the monostable multivibrator 290 of FIG. 13. For example, whereas the monostable multivibrator 290 responds to a negative-going voltage to apply a positive voltage, of about 15 milliseconds duration, to the solenoid driver 292, the monostable multivibrator 318 will respond to a positive-going signal to apply a positive voltage, of about fifteen milliseconds duration, to that solenoid driver. Moreover, the photo transistor 314 will coact with the amplifier 316, the monostable multivibrator 318, the solenoid driver 292 and the air-controlling solenoid 172 to move the cutter 168 downwardly to cutting position whenever the trailing edge of a stitched piece of material 245 moves rearwardly beyond the spot of light from the lamp 313, regardless of the number of stitches which are formed in the leading edge of the next-succeeding piece of material 246.

The preferred embodiment of FIG. 15 and 16 differs from the preferred embodiment of FIGS. 1–14 in substituting the mounting block 312 for the mounting block 154 of FIG. 7 and in eliminating the magnet 284, the Hall Effect Switch 286, the counter 288, and the flip-flop 296. As a result, the preferred embodiment of FIGS. 15 and 16 is less expensive than the preferred embodiment of FIGS. 1–14. Moreover, the length of the severed stitching, which trails behind the trailing edge of a piece of material 246 which has been stitched and cut by the preferred embodiment of FIGS. 15 and 16, will be wholly independent of the lengths of the stitches formed by the sewing machine 58.

Conclusion: By normally permitting reflected light to illuminate the photo transistors 136, 293, 302 and 314, the present invention provides specular sensing of the movement of the pieces of material 246. This is desirable; because such sensing makes the response of the guiding, stitching and delivering systems of FIGS. 1–14 and of FIGS. 15 and 16 essentially independent of fabric color, denier and weight. For example, even a very white fabric will have an index of reflectively which is sufficiently low, compared to those of the metals of which the platform 20, the hardened steel insert 21, and the supporting plate 168 are made, to enable each of the photo transistors 136, 293, 302 and 314, to sense the presence of that fabric.

The mounting block 56 can be shifted laterally, relative to the needle 106 of the sewing machine 58, to provide any desired spacing between the folded edges of the pieces of material 246 and the stitches which that sewing machine forms in those pieces of material. By loosening the screws 59 and by shifting the mounting block 56 to the left in FIG. 5, it is possible to reduce the distance between the folded edges of the pieces of material 246 and the stitches which the sewing machine 58 will form in those pieces of material. In the preferred embodiment of FIGS. 1–14, the distance between the folded edges of the pieces of material 246 and the stitches which the sewing machine 58 will form in such pieces of material can be varied by any desired value up to $1\frac{1}{4}$ of an inch. Thus, the folds on the pieces of material 246 can be made to have any desired lengths between $\frac{1}{2}$ and $1\frac{3}{4}$ of an inch.

The counter 288 can be set to count various numbers of pulses from the Hall Effect Switch 286 before it removes the positive voltage which it normally applies to the monostable multivibrator 290. As a result, that counter could be set to cause the blade 168 to move downwardly at the desired time—even where the sewing machine 58 must be set to form stitches of appreciably-different lengths.

If desired, a fold-forming jig or device could be located immediately ahead of the leading edge of the plate 26 in FIG. 1. Where that was done, the operator would introduce the various pieces of material 246 into that jig or device while those pieces of material were flat; and then that fold-forming jig or device would automatically fold the desired side edges of those pieces of material and then guide the leading edges of those pieces of material under the guide wheel 48.

If desired, the movable platform 242 could be mounted to move laterally, rather than longitudinally, of the direction of movement of the pieces of material 246. Moreover, if desired, a plural-section movable platform could be substituted for the movable platform 242; and such a plural-section movable platform could facilitate the stacking of even very large pieces of material. If any joint between sections of a plural-section movable platform were to be parallel to the direction of movement of the pieces of material 246, that joint should always be kept open at least three-quarters of an inch— to keep the portions of the sections which define that joint from gripping a piece of material as that joint is being closed.

The axes of the flaps 226 could be set so they were parallel to, or were at acute angles relative to, the direction of movement of the pieces of material 246. However, where those flaps are made tubular in form and are made of knitted or woven material, the setting of the axes of those flaps so they are perpendicular to the direction of movement of the pieces of material 246 is desirable because it vertically eliminates reveling of those flaps.

Whereas the drawing and accompanying description have shown and described two preferred embodiments of the present invention, it should be apparent to those skilled in the art that various changes may be made in the form of the invention without affecting the scope thereof.

What I claim is:

1. A material-handling system wherein objects are moved toward a stacking area by pulling forces which are applied to said objects by a delivering means, wherein a movable platform overlies said stacking area and can receive at least a part of the leading edge of an object being pulled toward said stacking area by said pulling forces applied by said delivering means, wherein a moving means can move said movable platform out of register with said stacking area and thereby permit said object, which is being pulled toward said movable platform by said pulling forces applied by said delivering to cause said movable platform to move out of wherein sensing means senses the movement of a selected edge of said object being pulled toward said stacking area by said pulling forces applied by said delivering means and actuates said moving means means to cause said movable platform to move out of register with said stacking means and thereby permit said object to fall downwardly into said stacking area, wherein said delivering means overlies at least a part of the upper surface of said movable platform so said delivering means can pull said part of said leading edge of said object onto said upper surface of said platform, and wherein said pulling forces applied by said delivering means continue to pull said object toward said stacking area after said sensing means has sensed movement of said selected edge of said object toward said stacking area and has actuated said moving means to cause said movable platform to start moving out of register with said stacking means, whereby said object continues to receive said pulling forces from said delivering means and thereby continues to move toward said stacking area until it falls away from and out of engagement with said delivering means.

2. A material-handling system which comprises a sewing machine that can form stitches in a piece of material, braking means for said sewing machine that selectively permits said sewing machine to form stitches or holds said sewing machine against forming stitches, means to sense the introduction of the leading edge of said piece of material into a position adjacent the needle of said sewing machine to make it possible for said braking means to permit said sewing machine to form stitches and also to sense the movement of the trailing edge of said piece of material beyond and away from said needle, said sensing means coacting with said braking means to cause said braking means to hold said sewing machine against forming stitches until the leading edge of said piece of material has been introduced into said position adjacent said needle of said sewing machine, whereby said sewing machine will not form needless and undesired stitches, said sensing means and said braking means coacting to brake said sewing machine, and thereby halt the forming of additional stitches, as the trailing edge of said piece of material moves beyond said sensing means and hence beyond and away from said needle of said sewing machine, said braking means permitting the momentum of said sewing machine to cause said sewing machine to form a limited number of stitches after said braking means has been actuated, at least some of said limited number of stitches forming a thread chain that trails behind the trailing edge of said piece of material and that will connect a next-succeeding piece of material to the first said piece of material while providing a short gap therebetween, and a counter which is "enabled" as said trailing edge of said piece of material moves out from under said sensing means, said counter counting said limited number of stitches which said sewing machine forms after said braking means has been actuated, said counter thereafter counting stitches that are formed in a next-succeeding piece of material, and said counter actuating a stitch-severing means after said braking means has freed said sewing machine to form stitches in said next-succeeding piece of material and when the sum of said limited number of stitches which said sewing machine forms plus the number of stitches which said sewing machine forms in said next-succeeding piece of material reaches a predetermined value, said predetermined value causing said stitch-severing means to sever that portion of said thread chain which defines said short gap.

3. A material-handling system wherein objects are moved toward a stacking area by advancing forces which are applied to said objects by a delivering means, wherein a movable platform overlies said stacking area and has one edge over which each object can pass so said movable platform can receive at least a part of the leading edge of each object being moved toward said stacking area by said advancing forces applied by said delivering means, wherein the opposite edge of said movable platform is unobstructed and is spaced from all nearby objects to permit the leading edges of long objects to pass beyond and droop downwardly from said opposite edge of said movable platform, wherein part of said delivering means overlies and is coextensive with at least a part of the upper surface of said movable platform so said advancing forces applied by said delivering means can cause said leading edges of said long objects to pass beyond and droop downwardly from said opposite edge of said movable platform, wherein a moving means can move said movable platform out of register with said stacking area and thereby permit any object, which is being moved toward said movable platform by said advancing forces applied by said delivering means, to fall downwardly into said stacking area, wherein sensing means senses the movement of the trailing edge of each object being moved toward said stacking area by said advancing forces applied by said delivering means, and wherein a circuit responds to the sensing by said sensing means of the trailing edge of each said object to cause said moving means to move said movable platform out of register with said stacking area and thereby permit said object to fall downwardly into said stacking area, whereby said material-handling system can stack pieces of material of different lengths without requiring any change in the position of said sensing means.

4. A material-handling system which comprises a sewing machine that can form stitches in a piece of material, braking means for said sewing machine that selectively permits said sewing machine to form stitches or holds said sewing machine against forming stitches, means to sense the introduction of the leading edge of said piece of material into a position adjacent the needle of said sewing machine to make it possible for said braking means to permit said sewing machine to form stitches and also to sense the movement of the trailing edge of said piece of material beyond and away from said needle, said sensing means coacting with said braking means to cause said braking means to hold said sewing machine against forming stitches until the leading edge of said piece of material has been introduced into said position adjacent said needle of said sewing machine, whereby said sewing machine will not form needless and undesired stitches, said sensing means and said braking means coacting to brake said sewing machine, and thereby halt the forming of additional stitches, as the trailing edge of said piece of material moves beyond said sensing means and hence beyond and away from said needle of said sewing machine, said braking means permitting the momentum of said sewing machine to cause said sewing machine to form a limited number of stitches after said braking means has been actuated, at least some of said limited number of stitches forming a thread chain that trails behind the trailing edge of said piece of material and that will connect a next-succeeding piece of material to the first said piece of material while providing a short gap therebetween, said sensing means sensing the leading edge of each said piece of material as said leading edge closely approaches said needle of said sewing machine and not enabling said braking means to permit said sewing machine to begin to form stitches until said leading edge of each said piece of material is immediately adjacent said needle, whereby substantially all of the stitches in the thread chain intermediate the trailing edge of one said piece of material and the leading edge of the next-succeeding piece of material are formed during the time said braking means is actuated and said braking means halts movement of said needle of said sewing machine, said thread chain having a length which is only a fraction of an inch so hand trimming of said thread chain is unnecessary.

5. A material-handling system as claimed in claim 4 wherein said sensing means senses said trailing edge of said piece of material as said trailing edge approaches said needle of said sewing machine, whereby said sensing means effects actuation of said braking means whenever the trailing edge of a piece of material approaches said needle of said sewing machine regardless of the length of said piece of material, whereby the same finite but short gap is formed between the trailing edge of a piece of material and the leading edge of the next-succeeding piece of material regardless of the lengths of said pieces of material.

6. A material-handling system which comprises a sewing machine that can form stitches in a piece of material, braking means for said sewing machine that selectively permits said sewing machine to form stitches or holds said sewing machine against forming stitches, means to sense the position of the trailing edge of a piece of material when that trailing edge is closely adjacent to the needle of said sewing machine, said sensing means coacting with said braking means to actuate said braking mean when the trailing edge of a piece of material is sensed by said sensing means, said braking means permitting the momentum of said sewing machine to cause said sewing machine to form a limited number of stitches after said braking means has been actuated, at least some of said limited number of stitches forming a thread chain that trails behind said trailing edge of said piece of material, said braking means holding said sewing machine at rest until a further piece of material is introduced into said sewing machine and thereby enabling said thread chain to define a finite but short gap between said trailing edge of the first said piece of material and the leading edge of said next-succeeding piece of material, said braking means releasing said sewing machine to form stitches in said further piece of material upon the introduction of said further piece of material into said sewing machine, said some of said limited number of stitches providing said finite but short gap between said trailing edge of said first said piece of material and said leading edge of said next-succeeding piece of material, a stitch-severing device which is disposed beyond said sewing machine in position to cut said thread chain, and means to enable said stitch-severing device to cut said thread chain adjacent the substantial midpoint of said thread chain and thereby form substantially equal, very short lengths of thread chain extending from said trailing edge of said first said piece of material and from said leading edge of said next-succeeding piece of material, whereby no trimming of said resulting short lengths of thread chain is required.

7. A material handling system wherein objects are moved toward a stacking area by advancing forces which are applied to said objects by a delivering means, wherein a movable platform overlies said stacking area and can receive at least a part of the leading edge of an object being moved toward said stacking area by said advancing forces applied by said delivering means, wherein a moving means can move said movable platform out of register with said stacking area and thereby permit said object, which is being moved toward said movable platform by said advancing forces applied by said delivering means, to fall downwardly into said stacking area, wherein sensing means senses the movement of a selected edge of said object being moved toward said stacking area by said advancing forces applied by said delivering means and actuates said moving means to cause said movable platform to move out of register with said stacking means and thereby permit said object to fall downwardly into said stacking area, wherein a fixed area is disposed in advance of said movable platform and said advancing forces applied by said delivering means move said object over said fixed area in a predetermined direction as they move said object toward said movable platform, and wherein said moving means causes said movable platform to move under said fixed area in a direction opposite to said predetermined direction as said moving means causes said movable platform to move out of register with said stacking area, whereby said movable platform is moved opposite to the direction of movement of said object as said movable platform is moved out of register with said stacking area and thereby provides relative movement between said object and said movable platform at a rate which is equal to the sum of the rate of movement of said object plus the rate of movement of said movable platform.

* * * * *